US007907878B2

(12) United States Patent
Takagi et al.

(10) Patent No.: US 7,907,878 B2
(45) Date of Patent: Mar. 15, 2011

(54) DEVELOPING ROLLER AND IMAGING APPARATUS USING THE SAME

(75) Inventors: Koji Takagi, Kanagawa (JP); Shuyou Akama, Saitama (JP)

(73) Assignee: Bridgestone Corporation, Tokyo (JP)

( * ) Notice: Subject to any disclaimer, the term of this patent is extended or adjusted under 35 U.S.C. 154(b) by 803 days.

(21) Appl. No.: 11/629,180

(22) PCT Filed: Jun. 8, 2005

(86) PCT No.: PCT/JP2005/010482

§ 371 (c)(1),
(2), (4) Date: Dec. 11, 2006

(87) PCT Pub. No.: WO2005/121905

PCT Pub. Date: Dec. 22, 2005

(65) Prior Publication Data

US 2007/0177909 A1 Aug. 2, 2007

(30) Foreign Application Priority Data

Jun. 9, 2004 (JP) ..... 2004-171353
Jun. 9, 2004 (JP) ..... 2004-171360
Jun. 9, 2004 (JP) ..... 2004-171410
Jun. 9, 2004 (JP) ..... 2004-171519

(51) Int. Cl.
*G03G 15/08* (2006.01)

(52) U.S. Cl. ..... 399/286

(58) Field of Classification Search ..... 399/265, 399/276, 279, 286; 492/17, 18, 53, 56, 59
See application file for complete search history.

(56) References Cited

U.S. PATENT DOCUMENTS 5,993,366 A * 11/1999 Kaji et al. ..... 492/56
6,154,626 A * 11/2000 Litman et al. ..... 399/282
6,253,053 B1 * 6/2001 Litman et al. ..... 399/286
6,458,063 B2 * 10/2002 Kodama ..... 492/59
2002/0031378 A1 3/2002 Arai et al.
2004/0170449 A1 * 9/2004 Sakata et al. ..... 399/286
2006/0056879 A1 * 3/2006 Jung et al. ..... 399/239
2007/0197362 A1 * 8/2007 Sakata et al. ..... 492/49
2008/0292366 A1 * 11/2008 Akama et al. ..... 399/286
2009/0010690 A1 * 1/2009 Kanesugi et al. ..... 399/336

FOREIGN PATENT DOCUMENTS

JP 9-197801 A 7/1997

(Continued)

OTHER PUBLICATIONS

Japanese Office Action dated Jan. 12, 2010 corresponding to Japanese Application No. 2006-514538, 4 pages.

(Continued)

*Primary Examiner* — Robert Beatty
(74) *Attorney, Agent, or Firm* — Sughrue Mion, PLLC

(57) ABSTRACT

A developing roller includes an ultraviolet-curing type resin layer and using a carbon-based electrically conducting agent for giving an electrical conductivity to the resin layer, as well as an imaging apparatus using the same. The developing roller 1 includes a shaft member 2 of a metal pipe and a resin layer 4. The resin layer 4 is a resin having fine particles dispersed therein, wherein the ratio a/b of average particle size of fine particles a to total thickness of resin layers b is greater than 2.0 and less than or equal to 5.0.

16 Claims, 5 Drawing Sheets

FOREIGN PATENT DOCUMENTS

| | | | | |
|---|---|---|---|---|
| JP | 9-226973 | A | | 9/1997 |
| JP | 10010857 | A | * | 1/1998 |
| JP | 11-184240 | A | | 7/1999 |
| JP | 11-348056 | A | | 12/1999 |
| JP | 2000-10399 | A | | 1/2000 |
| JP | 2000-075634 | A | | 3/2000 |
| JP | 2002-23485 | A | | 1/2002 |
| JP | 2002014534 | A | | 1/2002 |
| JP | 2002023485 | A | * | 1/2002 |
| JP | 2002-40801 | A | | 2/2002 |
| JP | 2002-82514 | A | | 3/2002 |
| JP | 2002-310136 | A | | 10/2002 |
| JP | 2003-228213 | A | | 8/2003 |

OTHER PUBLICATIONS

Japanese Office Action dated Oct. 6, 2009 (2 pages).

Japanese Office Action 2006-514538 dated May 18, 2010 with English translation (4 pages total).

* cited by examiner (a)

(b)

DEVELOPING ROLLER AND IMAGING APPARATUS USING THE SAME

TECHNICAL FIELD

This invention relates to a developing roller used in an imaging apparatus such as an electrophotographic apparatus, e.g. a copier, a printer or the like, an electrostatic recording apparatus and so on as well as an imaging apparatus using such a developing roller.

RELATED ART

In the imaging apparatus of an electrophotographic system such as a copier, a printer or the like, a non-magnetic developer (toner) is fed to a latent image support such as a photosensitive drum keeping a latent image to visualize the latent image through the toner attached to the latent image on the latent image support. As a general one of such developing methods, there is a non-magnetic jumping development process wherein a charged toner is carried on an outer periphery of a developing roller arranged at a slight gap to a latent image support and the developing roller is rotated at a state of applying a voltage between the latent image support and the developing roller to jump the toner to the latent image support.

The non-magnetic jumping development process will be further explained with reference to FIG. 1. A developing roller 91 is arranged between a toner feed roller 94 for feeding toners and a photosensitive drum (latent image support) 95 keeping an electrostatic latent image at a slight gap 92 to the photosensitive drum 95, and a predetermined voltage is applied between the photosensitive drum 95 and the developing roller 91 while rotating each of the developing roller 91, photosensitive drum 95 and toner feed roller 94 in a direction shown by an arrow in this figure, whereby toners 96 are fed to the surface of the developing roller 91 through the toner feed roller 94 and then the toners 96 are aligned to a uniform thin layer through a stratification blade 97 and thereafter the thin-layered toners 96 jump onto the photosensitive drum 95 over the gap 92 and attach to the latent image to conduct the visualization of the latent image.

Moreover, numeral 98 is a transfer portion, at where the toner image is transferred to a recording medium such as a paper or the like. Also, numeral 99 is a cleaning portion in which the toners 96 retaining on the surface of the photosensitive drum 95 after the transfer are removed by a cleaning blade 99*a*.

FIG. 2 is a diagrammatically section view of the conventional developing roller 91 used in the non-magnetic jumping development process. The developing roller 91 generally comprises a solid cylindrical or hollow cylindrical shaft member 82 made of a good electrical conductive material such as a metal or the like, and a resin layer 84 formed on an outer periphery thereof for optimizing a charging property or adhesion property to the toner or a friction force between the developing roller and the stratification blade, and so on (see, for example, Patent Document 1).

The shaft member 82 is preferable to be a hollow cylinder for the purpose of reducing the weight in view of an acceptable strength. In this case, it comprises a metal pipe 85 and a shaft-mounted cap 86 attached to each end of the metal pipe 85, in which a shaft part 86*a* constituting a longitudinal end portion of the shaft member 82 is arranged on the shaft-mounted cap 86 and born by a roller supporting portion of the imaging apparatus.

The resin layer 84 is formed by dipping the shaft member 82 into a solvent-type or an aqueous paint or spraying the paint onto the outer surface of the shaft member 82 and then drying and curing with heat or hot air, but it is required to take a long time for the drying. For this end, a long drying line is required for the mass production of the developing roller 91, and hence the cost required for the installation and space becomes voluminous. Also, the resin layer is required to have an electric conductivity and surface state controlled in a high precision from its applications, but the scattering in the temperature distribution and air flow amount in the drying line largely affects these performances and hence there is a problem in the quality.

As a countermeasure to these problems, there is known a developing roller obtained by curing an electrically conducting agent-containing ultraviolet-curing type resin applied to the shaft member 82 to form a coating layer (see, for example, Patent Document 2). On the other hand, as the electrically conducting agent giving the electric conductivity to the developing roller are generally and frequently used carbon-based materials in view of low cost, high electric conductivity, stability against environment and the like.

Patent Document 1: JP-A-2002-14534

Patent Document 2: JP A-2002-310136

DISCLOSURE OF THE INVENTION

Problems to be Solved by the Invention

However, the ultraviolet-curing type resin containing the carbon-based electrically conducting agent has a possibility that even if it is cured through the ultraviolet ray after the application, since carbon is transparent and absorbs the ultraviolet ray so that the ultraviolet ray does not arrive at the inside of the resin layer, the curing of the resin through the ultraviolet ray is not conducted sufficiently, so that there is a problem that the carbon-based material can not be used as the electrically conducting agent.

Also, the resin layer having the above construction is generally formed by applying the resin component-containing solution onto the shaft member and then curing. However, the resulting resin layer is insufficient in the surface roughness, and hence there is a possibility that the feeding ability is lacking when the toners are carried on the outer peripheral surface and fed to the latent image support.

Considering the above problems, the invention is to provide a developing roller capable of making the drying line in the formation of the resin layer useless and using the carbon-based material as the electrically conducting agent for giving the electric conductivity to the resin layer as well as an imaging apparatus using the same.

Also, the invention is to provide a developing roller having a surface roughness enough to provide a desired toner feeding ability and an imaging apparatus using the same.

Means for Solving Problems

A developing roller comprising a shaft member to be born at its both longitudinal end portions and at least one resin layer formed on a radially outer surface thereof for feeding a non-magnetic developing agent carried on an outer peripheral surface to a latent image support, wherein the shaft member is made of a metal pipe, and at least one of the resin layers is constituted with a ultraviolet-curing type resin containing an electrically conducting agent and a ultraviolet initiator, and the electrically conducting agent comprises at least carbon-based material, and the ultraviolet initiator has a maximum wavelength of not less than 400 nm in a ultraviolet absorption wavelength zone.

The "ultraviolet absorption wavelength zone" used herein means a wavelength zone capable of providing a sufficient energy for the cleavage of the initiator and does not include a wavelength zone merely showing a slight absorption. Therefore, the maximum wavelength of not less than 400 nm in the ultraviolet absorption wavelength zone means that the cleavage can be sufficiently started even at the wavelength zone of not less than 400 nm, and does not mean that the ultraviolet ray can be absorbed at this zone.

The ultraviolet initiator includes a maximum wavelength of less than 400 nm in the ultraviolet absorption wavelength zone.

The ultraviolet-curing type resin is formed by applying a solution of a solvent-free resin composition and curing through an irradiation of a ultraviolet ray.

A developing roller comprising a shaft member to be born at its both longitudinal end portions and at least one resin layer formed on a radially outer surface thereof for feeding a non-magnetic developing agent carried on an outer peripheral surface to a latent image support, wherein the shaft member is made of a metal pipe, and at least one of the resin layers is constituted with an electron beam curing type resin containing an electrically conducting agent.

The electron beam curing type resin used herein means a resin not containing a curing agent, a polymerization initiator and a cleavage assistant and having a property for proceeding a self-crosslinking by an energy through an irradiation of an electron beam without using these agents. In the actual production, however, the formation of the layer is allowed by compounding the curing agent and the like, so that it may be not rejected to compound the electron beam curing type resin with the curing agent and the like.

The electron beam curing type resin is formed by applying a solution of a solvent-free resin composition and curing through an irradiation of an electron beam.

The resin layer is constituted with two or more layers, and a layer located at an outermost side in a radial direction is a second resin layer and a layer adjoining at an inside of the second resin layer is a first resin layer, and the first resin layer has a volume resistivity of not more than $10^6$ Ω·cm and the second resin layer has a volume resistivity of not less than $10^{10}$ Ω·cm.

The second resin layer is constituted so as not to contain electrically conductive particles.

The resin constituting the second resin layer is a resin dissolving in a poor solvent to the resin constituting the first resin layer.

The second resin layer is made of a crosslinked resin and has a property that a soluble part in the extraction with a good solvent to the resin before the crosslinking is not more than 30% by weight.

A developing roller comprising a shaft member to be born at its both longitudinal end portions and at least one resin layer formed on a radially outer surface thereof for feeding a non-magnetic developing agent carried on an outer peripheral surface to a latent image support, wherein the shaft member is made of a metal pipe, and at least one of the resin layers is constituted with a resin dispersing fine particles therein.

The resin layer is constituted with two or more layers, and a layer located at an outermost side in a radial direction is a second resin layer and a layer adjoining at an inside of the second resin layer is a first resin layer, and the fine particles are not included in the second resin layer but are dispersed in only the first resin layer.

The first resin layer has a volume resistivity of not more than $10^6$ Ω·cm and the second resin layer has a volume resistivity of not less than $10^{10}$ Ω·cm.

The fine particles have an average particle size of 1-50 μm.

A content of the fine particles is 0.1-100 parts by weight per 100 parts by weight of the resin.

The resin layers have a thickness in total of 1-50 μm.

A ratio a/b of average particle size of fine particles a to total thickness of resin layers b is 1.0-5.0.

The fine particles are made from rubber or a synthetic resin.

The fine particles are at least one selected from silicone rubber fine particles, acryl fine particles, styrene fine particles, acryl-styrene copolymer fine particles, fluorine resin fine particles, urethane elastomer fine particles, urethane acrylate fine particles, melamine resin fine particles and phenolic resin fine particles.

At least one layer of the resin layers is made from a ultraviolet-curing type resin or an electron beam curing type resin.

The resin layer at least located at the outermost side in the radial direction is made from a resin containing at least one of fluorine and silicon.

The resin layers have a total thickness of 1-500 μm.

A content of the carbon-based electrically conducting agent included in the ultraviolet-curing type resin is 1-20 parts by weight per 100 parts by weight of the resin.

The electrically conducting agent included in the ultraviolet-curing type resin or the electron beam curing type resin is constituted with two or more kinds.

An elastic layer is arranged between the shaft member and the innermost resin layer.

The shaft member is made from a metal selected from aluminum, stainless steel, iron and an alloy containing any one thereof.

An imaging apparatus comprised a developing roller as described above.

Effect of the Invention

The ultraviolet initiator has a maximum wavelength of not less than 400 nm in the ultraviolet absorption wavelength zone, so that a long wavelength ultraviolet ray of not less than 400 nm can arrive at the inside of the resin layer and hence the ultraviolet curing reaction can be promoted while supplementing the reduction of ultraviolet amount at the inside of the layer through the carbon-based electrically conducting agent. Therefore, it is possible to use carbon-based materials as the electrically conducting agent to be included in the ultraviolet-curing type resin in view of various advantageous points.

The ultraviolet initiator has a maximum wavelength of less than 400 nm in the ultraviolet absorption wavelength zone, so that the curing reaction of the resin can be effectively promoted even in a portion near to the surface of the layer through the action of a short wavelength ultraviolet ray having a maximum wavelength of less than 400 nm.

The ultraviolet-curing type resin is formed by applying the solution of a solvent-free resin composition and curing through the irradiation of the ultraviolet ray, so that large-scale installation and space for the drying can be reduced as compared with the formation by drying and curing with heat or hot air instead of the irradiation of the ultraviolet ray, and also the resin layer can be formed in a higher precision while suppressing the scattering of the layer formation due to the fact that the control of the drying process is difficult.

At least one layer of the resin layers arranged on the outside of the shaft member is constituted with the electron beam curing type resin containing an electrically conducting agent, so that the drying line in the formation of the resin layer can be made useless, and the carbon-based material can be used as the electrically conducting agent capable of giving the electric conductivity to the resin layer without contaminating the latent image support different from the case of using the ultraviolet-curing type resin.

The electron beam curing type resin is formed by applying the solution of a solvent-free resin composition and curing through the irradiation of the electron beam, so that large-scale installation and space for the drying can be reduced as compared with the formation by drying and curing with heat or hot air instead of the irradiation of the electron beam, and also the resin layer can be formed in a higher precision while suppressing the scattering of the layer formation due to the fact that the control of the drying process is difficult.

The resin layer is constituted with two or more layers, and the volume resistivity of a second resin layer located at the radially outermost side is not less than $10^{10}$ Ω·cm and the volume resistivity of a first resin layer adjoining to the inner side of the second resin layer is not more than $10^{6}$ Ω·cm, so that the poor imaging such as image fogging, uneven image, ghost image or the like due to the fact that the charging ability to the developing agent is insufficient, or the poor imaging due to the developing agent attached to the developing roller can be suppressed sufficiently. Moreover, these facts are found out as a results of various experiments by the inventors.

The second resin layer is constituted so as not to contain electrical conductive fine particles, so that the insulating property of the second resin layer is more enhanced and stable images can be provided while well keeping the toner charging performance over a long time of period.

The resin constituting the second resin layer is a resin dissolving in a poor solvent to the resin constituting the first resin layer, so that when the solution for the second resin layer prepared by using the poor solvent is applied onto the first resin layer, the solvent used for the formation of the first resin layer is hardly dissolved by the solution for the second resin layer, and hence the good resin layers can be obtained without intermingling these resin layers with each other even in the drying at a so-called air drying state or the drying at room temperature.

The second resin layer is made of the crosslinked resin and has a property that the soluble part in the extraction with a good solvent to the resin before the crosslinking is not more than 30% by weight, so that there can be prevented a problem that if the soluble part exceeds 30% by weight, a relatively low molecular weight component and an uncured component become large, which results in the lacking of durable life, contamination of a photosensitive body, contamination or aggregation of toners, wearing of the coated layer, increase of friction coefficient and the like.

At least one layer of the resin layers is made from the resin dispersing fine particles therein, so that the unevenness produced by the fine particles can be formed on the outer peripheral surface, whereby there can be provided a developing roller having a surface roughness enough to provide a desired toner feeding ability.

The resin layer is constituted with two or more layers and the fine particles are not included in the second resin layer located at the radially outermost side but are dispersed in only the first resin layer adjoining to the inside of the second resin layer, so that the fine particles in the first resin layer are not directly exposed to the developing roller by the second resin layer, and hence the dropout of the fine particles can be prevented and the surface roughness formed by the fine particles can be maintained over a long time of period.

The volume resistivity of the first resin layer is not more than $10^{6}$ Ω·cm and the volume resistivity of the second resin layer is not less than $10^{10}$ Ω·cm, so that the poor imaging such as image fogging, uneven image, ghost image or the like due to the fact that the charging ability to the developing agent is insufficient, or the poor imaging due to the developing agent attached to the developing roller can be suppressed sufficiently.

The average particle size of the fine particles is 1-50 μm, so that an optimum toner transporting force can be obtained. When the average particle size of the fine particles is less than 1 μm, the sufficient surface roughness is not obtained and hence the toner transporting force lowers to bring about the deterioration of printing quality such as lowering of the image concentration or like, while when it exceeds 50 μm, the surface roughness is too large and the toner transporting force becomes excessive and an adequate toner charging property can not be ensured.

The content of the fine particles is 0.1-100 parts by weight per 100 parts by weight of the resin, so that the optimum surface roughness can be obtained. When the content of the fine particles is less than 0.1 part by weight per 100 parts by weight of the resin, the existing ratio of the fine particles in the first resin layer is too small and the sufficient surface roughness can not be given to the developing roller, while when it exceeds 100 parts by weight, the ratio of the fine particles to the resin is too large and the expression of the function of the resin is obstructed and the good layer is hardly obtained.

The total thickness of the resin layers is 1-50 μm, so that it can contribute to good image formation. When the thickness is less than 1 μm, the charging performance of the surface layer may not be sufficiently ensured due to the friction in the endurance, while when it exceeds 50 μm, the surface of the developing roller becomes hard to give damages to the toner and hence the fixation of the toners to an image forming body such as a photosensitive body or the like or the stratification blade may be caused to form a poor image.

The ratio a/b of average particle size of fine particles a to total thickness of resin layers b is 1.0-5.0. When the ratio a/b is less than 1.0, the fine particles are embedded in the resin and it is difficult to make the surface roughness of the developing roller large, while when it exceeds 5.0, it is difficult to fix the fine particles by the resin.

The fine particles are made from rubber or synthetic resin, so that the fine particles are easily and uniformly dispersed into the resin, and also the lowering of the electric resistance is not caused different from the case of using metal particles.

The fine particles are at least one selected from silicone rubber fine particles, acryl fine particles, styrene fine particles, acryl-styrene copolymer fine particles, fluorine resin fine particles, urethane elastomer fine particles, urethane acrylate fine particles, melamine resin fine particles and phenolic resin fine particles, so that the uniform distribution of fine particles is easily obtained, and also the desired toner charging property is easily obtained.

At least one layer of the resin layers is made from the ultraviolet-curing type resin or the electron beam curing type resin, so that the applied resin can be cured by irradiating the ultraviolet ray or the electron beam, and a large-scale drying line required for the curing in case of using the thermoplastic resin can be made useless and the cost therefor can be largely reduced.

At least outermost resin layer is made from the resin containing at least one of fluorine and silicon, so that the surface energy of the outermost resin layer can be reduced, and hence the friction resistance of the developing roller is lowered and the releasability of the toner is improved, and the friction can be reduced in the use over a long time of period to improve the durability.

The total thickness of the resin layers is 1-500 μm, so that the stable image can be formed over a long time of period. When the thickness is less than 1 μm, the sufficient charging performance of the surface layer may not be ensured due to the friction in the use over a long time of period, while when it exceeds 500 μm, the surface of the developing roller becomes hard to give damages to the toner and hence the fixation of the toners to an image forming body such as a photosensitive body or the like or the stratification blade may be caused to form a poor image.

The content of the carbon-based electrically conducting agent included in the ultraviolet-curing type resin is 1-20 parts by weight per 100 parts by weight of the resin, so that the optimum electrical characteristics can be provided. When the content of the carbon-based electrically conducting agent is less than 1 part by weight, the sufficient electric conductivity can not be ensured, while when it exceeds 20 parts by weight, the resin becomes hard and brittle and there is a fear of causing leakage in use due to the considerably increase of the electric conductivity, and further since the carbon-based electrically conducting agent easily absorbs the ultraviolet ray, as the amount of the electrically conducting agent becomes larger, the ultraviolet ray does not arrive at the inside of the layer and hence the ultraviolet curing reaction is not promoted sufficiently.

Two or more electrically conducting agents are included in the ultraviolet-curing type resin or the electron beam curing type resin, so that the electric conducting property can be stably developed without influencing on the variation of the voltage applied or the change of environment.

The elastic layer is arranged between the shaft member and the radially innermost resin layer, so that the stress applied to the resin layer is mitigated when the resin layer is pushed onto the latent image support or the stratification blade, whereby the durability of the resin layer is improved, but also the stress to the toners can be mitigated to contribute to the formation of stable images over a long time of period.

Also, as the development process using the non-magnetic toner, there is a pressurized developing process wherein a developing roller is pushed onto the latent image support for the development in addition to the jumping development process. In case of applying the above developing roller to the pressurized developing process, the stress from the latent image support can be further mitigated, which can more contribute to the durability of the resin layer and the maintenance of the developing performance over a long time of period.

The shaft member is made from a metal selected from aluminum, stainless steel, iron and an alloy containing any one thereof, so that the sufficient electric conducting property is ensured and also the strength, durability, workability and the like become advantageous.

The apparatus comprises the above described developing roller, so that the drying line in the formation of the resin layer can be made useless as previously mentioned, and also the carbon-based material can be used as the electrically conducting agent for giving the electric conductivity to the resin layer, and hence there can be provided an advantageous imaging apparatus.

BEST MODE FOR CARRYING OUT THE INVENTION

Figure 3:
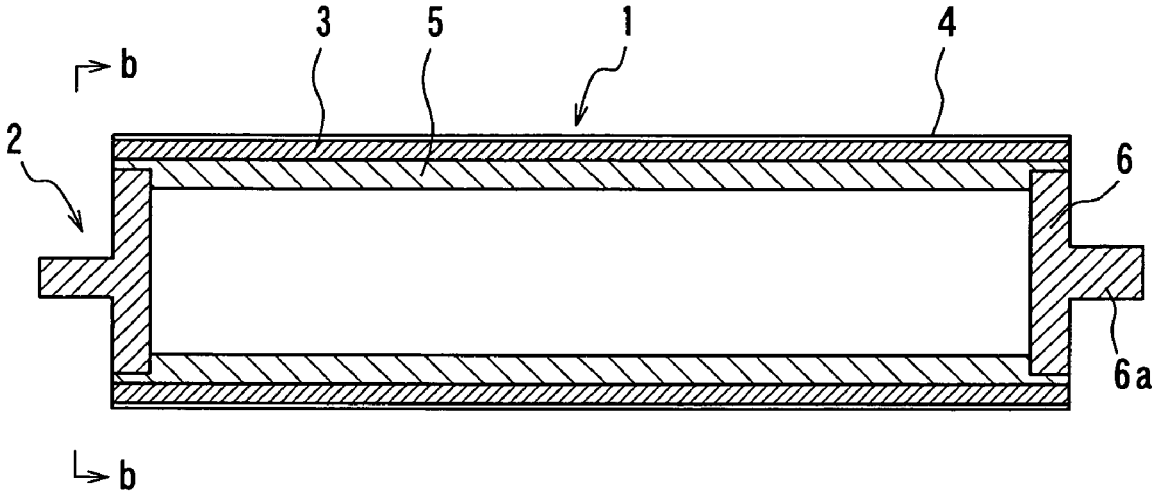
FIG. 3 is a section view and a side view illustrating the developing roller according to an embodiment of the invention.
Figure 3:
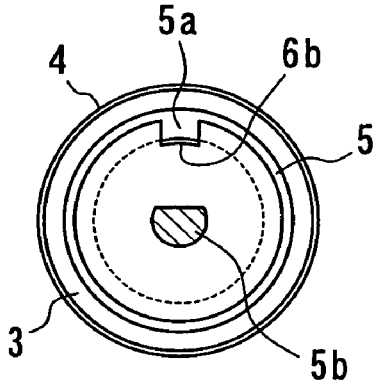

An embodiment of the invention will be described in detail. FIG. 3(*a*) is a section view of an embodiment of the developing roller according to the invention, and FIG. 3(*b*) is a side view taken along an arrow line b-b of FIG. 3(*a*). The developing roller 1 is constituted by forming a semiconductive elastic layer 3 on an outer periphery of a shaft member 2 and further forming a semiconductive resin layer 4 on the elastic layer 3, but the elastic layer 3 is not an essential component. The shaft member 2 comprises a metal pipe 5 of a follow cylinder and a shaft-mounted cap 6 attached to each end of the metal pipe 5, in which a shaft part 6*a* constituting a longitudinal end portion of the shaft member 2 is arranged on the shaft-mounted cap 6 and born by a roller supporting portion of an imaging apparatus not shown.

The shaft member 2 has a good electric conductivity because of a metal. The metal material used in the shaft member 2 is not particularly limited, but may include, for example, iron, stainless steel, aluminum and alloys containing them.

The thickness of the pipe is preferable to become thinner in view of the weight reduction as far as it has a sufficient strength and may be, for example, 0.3-2 mm. In the assembling of the metal pipe 5 and the shaft-mounted cap 6, as shown in FIG. 3(*b*), a convex part 5*a* arranged on the metal pie 5 is engaged with a concave part 6*b* arranged in the shaft-mounted cap 6 for preventing the relative rotation, and thereafter the metal pipe 5 may be fixed to the shaft-mounted cap 6 with an adhesive, a pin stop or the like.

In the resin layer 4, the characteristics such as electric resistance, surface properties and the like are set so that a given charged amount is given to toners and a given toner transporting amount can be provided in accordance with specifications of a toner and an imaging apparatus and also the feeding amount of toners to a latent image support is made to a predetermined level.

Also, the resin layer 4 may be constituted with one layer or plural layers having different materials or properties, in which at least one layer is made from a ultraviolet-curing type resin or an electron beam curing type resin containing a carbon-based electrically conducting agent. Moreover, FIG. 3 shows a developing roller in which the resin layer 4 is one layer.

As the ultraviolet-curing type resin or electron beam curing type resin forming the resin layer 4 are mentioned a polyester resin, a polyether resin, a fluorine resin, an epoxy resin, an amino resin, a polyamide resin, an acrylic resin, an acrylurethane resin, a urethane resin, an alkyd resin, a phenolic resin, a melamine resin, a urea resin, a silicone resin, a polyvinylbutyral resin and the like, These resins may be used alone or in a combination of two or more.

Also, a modified resin obtained by introducing a particular functional group into the above resin can be used. Furthermore, it is preferable to introduce a crosslinking structure in order to improve the dynamic strength and environment resistance of the resin layer 4.

Among the above resins, it is particularly preferable to be a composition comprising a ultraviolet-curing type resin or electron beam curing type resin of (metha)acrylate system inclusive of (metha)acrylate oligomer.

As the (metha)acrylate oligomer may be mentioned, for example, urethane-based (metha)acrylate oligomer, epoxy-based (metha)acrylate oligomer, ether-based (metha)acrylate oligomer, polycarbonate-based (metha)acrylate oligomer, fluorine or silicon-based (metha)acryl oligomer and so on.

The (metha)acrylate oligomer may be synthesized by reacting a compound such as polyethylene glycol, polyoxypropylene glycol, polytetramethylene ether glycol, bisphenol A-type epoxy resin, phenol novolac type epoxy resin, addition product of polyhydric alcohol and ϵ-caprolactone or the like with (metha)acrylic acid, or by urethanation of a polyisocyanate compound and a hydroxyl group-containing (metha)acrylate compound.

The urethane-based (metha)acrylate oligomer can be obtained by urethanation of a polyol, an isocyanate compound and a hydroxyl group-containing (metha)acrylate compound.

As an example of the epoxy-based (metha)acrylate oligomer may be any reaction products between a glycidyl group-containing compound and (metha)acrylic acid. Among them, a reaction product between a glycidyl group-containing compound having a cyclic structure such as benzene ring, naphthalene ring, spiro ring, dicyclopentadiene, tricyclodecane or the like and (metha)acrylic acid is preferable.

Further, the ether-based (metha)acrylate oligomer, ester-based (metha)acrylate oligomer and polycarbonate-based (metha)acrylate oligomer may be obtained by reacting the respective polyol (polyether polyol, polyester polyol and polycarbonate polyol) with (metha)acrylic acid.

The resin composition of the ultraviolet-curing type or electron beam curing type is compounded with a reactive diluent having a polymerizable double bond for the adjustment of viscosity, if necessary. As the reactive diluent can be used, for example, monofunctional, difunctional or polyfunctional polymerizable compounds having such a structure that (metha)acrylic acid is bonded to an amino acid or a hydroxyl group-containing compound through esterification or amidation, and so on. Such a diluent is preferable to be usually used in an amount of 10-200 parts by weight per 100 parts by weight of (metha)acrylate oligomer.

For the purpose of controlling the electrical conducting property, the ultraviolet-curing type resin or electron beam curing type resin constituting the resin layer 4 is compounded with an electrically conducting agent. Since a carbon-based electrically conducting agent can provide a high electric conductivity at a small addition amount, a carbon-based material is used at least as an electrically conducting agent in the developing roller 1 according to the invention. As the carbon-based electrically conducting agent are preferably used Ketjenblack and acetylene black, but carbon blacks for rubber such as SAF, ISAF, HAF, FEF, GPF, SRF, FT, MT and the like, carbon blacks for ink such as oxidation carbon black and the like, pyrolytic carbon black, graphite and so on may be used.

The amount of the carbon-based electrically conducting agent compounded is not more than 100 parts by weight per 100 parts by weight of the resin, preferably 1-100 parts by weight, more preferably 1-80 parts by weight, particularly 10-50 parts by weight when it is included in the electron beam curing type resin, and not more than 20 parts by weight per 100 parts by weight of the resin, preferably 1-20 parts by weight, more preferably 1-10 parts by weight, particularly 2-5 parts by weight when it is included in the ultraviolet-curing type resin. In the latter case, since the carbon-based electrically conducting agent easily absorbs the ultraviolet ray, when the amount exceeds 20 parts by weight, there is a fear that as the amount of the electrically conducting agent becomes larger, the ultraviolet ray does not arrive at the inside of the layer and hence the curing reaction through the ultraviolet ray is not promoted sufficiently.

As the electrically conducting agent, two or more kinds may be mixed. In this case, the electric conducting property can be stably developed even on the variation of voltage applied or change of environment. As a mixed example may be mentioned a mixture of the carbon-based electrically conducting agent and an electronic or ionic electrically conducting agent other than the carbon-based material.

When the ionic electrically conducting agent is included as the electrically conducting agent in addition to the carbon-based material, the amount of the ionic electrically conducting agent compounded in the resin layer 4 is not more than 20 parts by weight, preferably 0.01-20 parts by weight, more preferably 1-10 parts by weight per 100 parts by weight of the resin.

As the ionic electrically conducting agent may be mentioned an organic ionic electrically conducting agent such as perchlorate, hydrochloride, borate, iodate, borofluorohydrate, sulfate, alkylsulfate, carboxylate, sulfonate and the like of ammoniums such as tetraethyl ammonium, tetrabutyl ammonium, a dodecyltrimethyl ammonium such as lauryltrimetyhyl ammonium or the like, hexadecyltrimethyl ammonium, an octadecyltrimethyl ammonium such as stearyltrimethylammonium or the like, benzyltrimethyl ammonium, modified aliphatic dimethylethyl ammonium and so on; and an inorganic ionic electrically conducting agent such as perchlorate, hydrochloride, borate, iodate, borofluorohydrate, trifluoromethyl sulfate, sulfonate and the like of an alkyl metal or alkaline earth metal such as lithium, sodium, calcium, magnesium or the like.

When the electronic electrically conducting agent is used as the electrically conducting agent in addition to the carbon-based material, the amount of the electronic electrically conducting agent compounded is preferable to be not more than 100 parts by weight, preferably 1-80 parts by weight, more preferably 10-50 parts by weight per 100 parts by weight of the resin.

As the electronic electrically conducting agent other than the carbon-based material may be mentioned fine particles of a metal oxide such as ITO, tin oxide, titanium oxide, zinc oxide or the like; oxides of nickel, copper, silver, germanium and the like; a transparent whisker such as electrically conductive titanium oxide whisker, electrically conductive barium titanate whisker or the like; and so on.

In the developing roller 1 according to the invention, when the resin layer 4 is constituted with the ultraviolet-curing type resin, a ultraviolet initiator is included at the formation step for promoting the start of the curing reaction of the resin, while since the carbon-based material is included as the electrically conducting agent for giving the electric conductivity to the resin layer 4, there is a possibility that the ultraviolet ray does not arrive at the inside of the layer due to the carbon-based electrically conducting agent, and hence the ultraviolet initiator can not develop its functions sufficiently, which results in a factor hardly promoting the curing reaction.

In order to improve this point, a ultraviolet initiator having a maximum wavelength of not less than 400 nm in a ultraviolet absorption wavelength zone is used for absorbing a long wavelength ultraviolet capable of arriving at the inside of the layer in the developing roller 1 according to the invention. As such a ultraviolet initiator may be mentioned α-aminoacetophenon, acylphosphine oxide, thioxanthononamine and the like, which may concretely include bis(2,4,6-trimethylbenzoyl)-phenylphosphine oxide or 2-methyl-1-[4-(methylthio)phenyl]-2-morpholinopropane-1-on.

Also, the ultraviolet initiator is preferable to include a short wavelength having a maximum wavelength of less than 400 nm in the ultraviolet absorption wavelength zone in addition to the long wavelength having a maximum wavelength of not less than 400 nm in the ultraviolet absorption wavelength zone. Thus, the curing reaction can be promoted not only at the inside of the layer but also in the vicinity of the surface of the layer when using the carbon-based electrically conducting agent.

As the ultraviolet initiator having such a short wavelength absorption zone may be mentioned 2,2-dimethoxy-1,2-diphenylethane-1-on, 1-hydroxy-cyclohexyl-phenylketone, 2-hydroxy-2-methyl-1-phenylpropane-1-on, 1-[4-(2-hydroxyethoxy)phenyl]-2-hydroxy-2-methyl-1-propane-1-on, 2-methyl-1-[4-phenyl]-2-morpholinopropane-1-on and the like.

In case of compounding the ultraviolet initiator, the amount is preferable to be 0.1-10 parts by weight per 100 parts by weight of (metha)acrylate oligomer.

In the invention, a tertiary amine such as triethylamine, triethanolamine or the like, an alkylphosphine photopolymerization promoter such as triphenylphosphine or the like, a thioether-based photopolymerization promoter such as p-thiodiglycol or the like may be added to the ultraviolet-curing type resin in addition to the aforementioned components for promoting the polymerization reaction through the above polymerization initiator. In case of adding these compounds, the addition amount is preferable to be usually 0.01-10 parts by weight per 100 parts by weight of (metha)acrylate oligomer.

As to the resin layer 4 at least located at the outermost side, it is preferable that either fluorine or silicon or both are included in the resin constituting such a layer. In this case, the surface energy of the outermost resin layer can be reduced, and hence the friction resistance of the developing roller is lowered and the releasability of the toners is improved and the wearing in the use over a long time of period can be reduced to improve the durability.

A raw material forming the fluorine-containing ultraviolet-curing type resin or electron beam curing type resin is preferable to contain a fluorine-containing compound having a polymerizable double bond between carbon atoms. The raw material may be comprised of only the fluorine-containing compound having a polymerizable double bond between carbon atoms, or may be a composition of the fluorine-containing compound having a polymerizable double bond between carbon atoms and the other compound having a polymerizable double bond between carbon atoms As the fluorine-containing compound having a polymerizable double bond between carbon atoms is preferable a compound such as oligomer containing fluoroolefin as a constituting material or the like, or a fluoro(metha)acrylate.

As the fluoro(metha)acrylate is preferable a fluoroalkyl (metha)acrylate having a carbon number of 5-16 in which one or all hydrogen atoms are replaced with fluorine, which may include 2,2,2-trifluoroethyl acrylate ($CF_3CH_2OCOCH{=}CH_2$, fluorine content: 34% by weight), 2,2,3,3,3-pentafluoropropyl acrylate ($CF_3CF_2CH_2OCOCH{=}CH_2$, fluorine content: 44% by weight), $F(CF_2)_4CH_2CH_2OCOCH{=}CH_2$ (fluorine content: 51% by weight), 2,2,2-trifluoroethyl acrylate ($CF_3CH_2OCOCH{=}CH_2$, fluorine content: 37% by weight), 2,2,3,3,3-pentafluoropropyl acrylate ($CF_3CF_2CH_2OCOCH{=}CH_2$, fluorine content: 47% by weight), 2-(perfluorobutyl)ethy acrylate [$F(CF_2)_4CH_2CH_2OCOCH{=}CH_2$, fluorine content: 54% by weight], 3-(perfluorobutyl)-2-hydroxypropyl acrylate [$F(CF_2)_4CH_2CH(OH)CH_2OCOCH{=}CH_2$, fluorine content: 49% by weight], 2-(perfluorohexyl)ethyl acrylate [$F(CF_2)_6CH_2OCOCH{=}CH_2$, fluorine content: 59% by weight], 3-(perfluorohexyl)-2-hydroxypropyl acrylate [$F(CF_2)_6CH_2CH(OH)CH_2OCOCH{=}CH_2$, fluorine content: 55% by weight], 2-(perfluorooctyl)ethyl acrylate [$F(CF_2)_8CH_2CH_2OCOCH{=}CH_2$, fluorine content: 62% by weight], 3-(perfluorooctyl)-2-hydroxypropyl acrylate [$F(CF_2)_8CH_2CH(OH)CH_2OCOCH{=}CH_2$, fluorine content: 59% by weight], 2-(perfluorodecyl)ethy acrylate [$F(CF_2)_{10}CH_2CH_2OCOCH{=}CH_2$, fluorine content: 65% by weight], 2-(perfluoro-3-methylbutyl)ethyl acrylate [$(CF_3)_2CF(CF_2)_2CH_2CH_2OCOCH{=}CH_2$, fluorine content: 57% by weight], 3-(perfluoro-3-methylbutyl)-2-hydroxypropyl acrylate [$(CF_3)_2(CF_2)_2CH_2CH(OH)CH_2OCOCH{=}CH_2$, fluorine content: 52% by weight], 2-(perfluoro-5-methylhexyl)ethyl acrylate [$(CF_3)_2CF(CF_2)_4CH_2CH_2OCOCH{=}CH_2$, fluorine content: 61% by weight], 3-(perfluoro-5-methylhexyl)-2-hydroxypropyl acrylate [$(CF_3)_2CF(CF_2)_4CH_2CH(OH)CH_2OCOCH{=}CH_2$, fluorine content: 57% by weight], 2-(perfluoro-7-methyloctyl)ethyl acrylate [$(CF_3)_2CF(CF_2)_6CH_2CH_2OCOCH{=}CH_2$, fluorine content: 64% by weight], 3-(perfluoro-7-methyloctyl)-2-hydroxypropyl acrylate [$(CF_3)_2CF(CF_2)_6CH_2CH(OH)CH_2OCOCH{=}CH_2$, fluorine content: 60% by weight], 1H,1H,3H-tetrafluoropropyl acrylate [$H(CF_2)_2CH_2OCOCH{=}CH_2$, fluorine content: 41% by weight], 1H,1H,5H-octafluoropentyl acrylate [$H(CF_2)_4CH_2OCOCH{=}CH_2$, fluorine content: 53% by weight], 1H,1H,7H-dodecafluoroheptyl acrylate [$H(CF_2)_6CH_2OCOCH{=}CH_2$, fluorine content: 59% by weight], 1H,1H,9H-hexadecafluorononyl acrylate [$H(CF_2)_8CH_2OCOCH{=}CH_2$, fluorine content: 63% by weight], 1H-1-(trifluoromethyl)trifluoroethyl acrylate [$(CF_3)_2CHOCOCH{=}CH_2$, fluorine content: 51% by weight], 1H,1H,3H-hexafluorobutylacrylate [$CF_3CHFCF_2CH_2OCOCH{=}CH_2$, fluorine content: 48% by weight], 2,2,2-trifluoroethyl methacrylate [$CF_3CH_2OCOC(CH_3){=}CH_2$, fluorine content: 34% by weight], 2,2,3,3,3-pentafluoropropyl methacrylate [$CF_3CF_2CH_2OCOC(CH_3){=}CH_2$, fluorine content: 44% by weight], 2-(perfluorobutyl)ethyl methacrylate [$F(CF_2)_4CH_2CH_2OCOC(CH_3){=}CH_2$, fluorine content: 51% by weight], 3-(perfluorobutyl)-2-hydroxy-propyl methacrylate [$F(CF_2)_4CH_2CH(OH)CH_2OCOC(CH_3){=}CH_2$, fluorine content: 47% by weight], 2-(perfluorohexyl)ethyl methacrylate [$F(CF_2)_6CH_2CH_2OCOC(CH_3){=}CH_2$, fluorine content: 57% by weight], 3-(perfluorohexyl)-2-hydroxypropyl methacrylate [$F(CF_2)_6CH_2CH(OH)CH_2OCOC(CH_3){=}CH_2$, fluorine content: 53% by weight], 2-(perfluorooctyl)ethyl methacrylate [$F(CF_2)_8CH_2CH_2OCOC(CH_3){=}CH_2$, fluorine content: 61% by weight], 3-perfluorooctyl-2-hydroxypropyl methacrylate [$F(CF_2)_8CH_2CH(OH)CH_2OCOC(CH_3)=CH_2$, fluorine content: 57% by weight], 2-(perfluorodecyl)ethyl methacrylate [$F(CF_2)_{10}CH_2CH_2OCOC(CH_3)=CH_2$, fluorine content: 63% by weight], 2-(perfluoro-3-methylbutyl)ethyl methacrylate [$(CF_3)_2CF(CF_2)_2CH_2CH_2OCOC(CH_3)=CH_2$, fluorine content: 55% by weight], 3-(perfluoro-3-methylbutyl)-2-hydroxypropyl methacrylate [$(CF_3)_2CF(CF_2)_2CH_2CH(OH)CH_2OCOC(CH_3)=CH_2$, fluorine content: 51% by weight], 2-(perfluoro-5-methylhexyl)ethyl methacrylate [$(CF_3)_2CF(CF_2)_4CH_2CH_2OCOC(CH_3)=CH_2$, fluorine content: 59% by weight], 3-(perfluoro-5-methylhexyl)-2-hydroxypropyl methacrylate [$(CF_3)_2CF(CF_2)_4CH_2CH(OH)CH_2OCOC(CH_3)=CH_2$, fluorine content: 56% by weight], 2-(perfluoro-7-methyloctyl)ethyl methacrylate [$(CF_3)_2CF(CF_2)_6CH_2CH_2OCOC(CH_3)=CH_2$, fluorine content: 62% by weight], 3-(perfluoro-7-methyloctyl)-2-hydroxypropyl methacrylate [$(CF_3)_2CF(CF_2)_6CH_2CH(OH)CH_2OCOC(CH_3)=CH_2$, fluorine content: 59% by weight], 1H,1H,3H-tetrafluoropropyl methacrylate [$H(CF_2)_2CH_2OCOC(CH_3)=CH_2$, fluorine content: 51% by weight], 1H,1H,5H-octafluoropentyl methacrylate [$H(CF_2)_4CH_2OCOC(CH_3)=CH_2$, fluorine content: 51% by weight], 1H,1H,7H-dodecafluoroheptyl methacrylate [$H(CF_2)_6CH_2OCOC(CH_3)=CH_2$, fluorine content: 57% by weight], 1H,1H,9H-hexadecafluorononyl methacrylate [$H(CF_2)_8CH_2OCOC(CH_3)=CH_2$, fluorine content: 61% by weight], 1H-1-(trifluoromethyl)triflyoroethyl methacrylate [$(CF_3)_2CHOCOC(CH_3)=CH_2$, fluorine content: 48% by weight], 1H,1H,3H-hexafluoropropyl methacrylate [$CF_3CHFCF_2CH_2OCOC(CH_3)=CH_2$, fluorine content: 46% by weight] and so on.

The fluorine-containing compound having a polymerizable double bond between carbon atoms is preferable to be a monomer, an oligomer or a mixture of a monomer and an oligomer. As the oligomer are preferable 2-20 mers.

The other compound having a polymerizable double bond between carbon atoms to be blended with the fluorine-containing compound having a polymerizable double bond between carbon atoms is not particularly limited, but is preferable to be (metha)acrylate monomer or oligomer, or a mixture of monomer and oligomer.

As the (metha)acrylate monomer or oligomer may be mentioned, for example, monomers or oligomers such as urethane-based (metha)acrylates, epoxy-based (metha)acrylates, ether-based (metha)acrylates, ester-based (metha) acrylates, polycarbonate-based (metha)acrylates; silicon-based (metha)acryl monomer or oligomer, and so on.

The (metha)acrylate oligomer may be synthesized by reacting a compound such as polyethylene glycol, polyoxypropylene glycol, polytetrametylene ether glycol, bisphenol A-type epoxy resin, phenol novolac type epoxy resin, an addition product of polyhydric alcohol and ϵ-caprolacton or the like with (metha)acrylic acid, or by urethanation of a polyisocyanate compound and a hydroxyl group-containing (metha)acrylate compound.

The urethane-based (metha)acrylate oligomer is obtained by urethanation of a polyol, an isocyanate compound and a hydroxyl group-containing (metha)acrylate compound.

As an example of the epoxy-based (metha)acrylate oligomer may be any reaction products between a glycidyl group-containing compound and (metha)acrylic acid. Among them, a reaction product between a glycidyl group-containing compound having a cyclic structure such as benzene ring, naphthalene ring, spiro ring, dicyclopentadiene, tricyclodecane or the like and (metha)acrylic acid is preferable.

Further, the ether-based (metha)acrylate oligomer, ester-based (metha)acrylate oligomer and polycarbonate-based (metha)acrylate oligomer may be obtained by reacting the respective polyol (polyether polyol, polyester polyol and polycarbonate polyol) with (metha)acrylic acid.

Also, a raw material forming the silicon-containing ultraviolet-curing type resin or electron beam curing type resin is preferable to contain a silicon-containing compound having a polymerizable double bond between carbon atoms. The raw material may be comprised of only the silicon-containing compound having a polymerizable carbon-carbon double bond, or may be a composition of the silicon-containing compound having a polymerizable carbon-carbon double bond and the other compound having a polymerizable carbon-carbon double bond As the silicon-containing compound having a polymerizable carbon-carbon double bond are both-terminal reactive silicone oils, one-side terminal reactive silicone oils, and (metha)acryloxyalkyl silanes. As the reactive silicone oil, it is preferable to introduce (metha)acryl group into its terminal.

A concrete example of the silicon-containing compound suitable for the invention is as follows.

TABLE 1

Both-terminal reactive silicone oil, made by Shin-Etsu Chemical Co., Ltd.

| Part Number | Functional group | Viscosity ($mm^2/s$) | Equivalent of functional group (g/mol) |
|---|---|---|---|
| X-22-164A | $-C_3H_6OC(=O)C(CH_3)=CH_2$ | 25 | 860 |
| X-22-164B | | 55 | 1630 |
| X-22-164C | | 90 | 2370 |

TABLE 2

One-terminal reactive silicon oil, made by Shin-Etsu Chemical Co., Ltd.

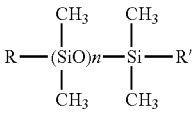

| Part Number | Functional group | Viscosity ($mm^2/s$) | Equivalent of functional group (g/mol) |
|---|---|---|---|
| X-24-8201 | $-C_3H_6OC(=O)C(CH_3)=CH_2$ | 25 | 2100 |
| X-22-174DX | | 60 | 4600 |
| X-22-2426 | | 180 | 12000 |

TABLE 3

Silicone oil modified at both terminals with methacrylate, made by Toray-Dow Coring-Silicon Co., Ltd.

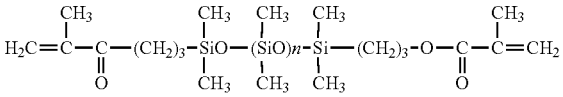

| Part Number | Viscosity (cs/25° C.) | Methacryl equivalent (g/mol) | Specific gravity (25° C.) |
|---|---|---|---|
| BX16-152B | 40 | 1300 | 0.97 |
| BY16-152 | 85 | 2800 | 0.97 |
| BX2-152C | 330 | 5100 | 0.97 |

TABLE 4

Silicone oil modified at one terminal with methacrylate, made by Toray-Dow Corning-Silicon Co., Ltd.

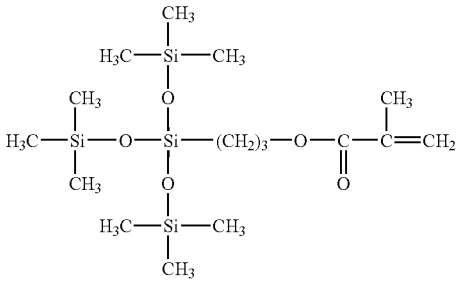

| Part Number | Viscosity (cs/25° C.) | Refractive index (25° C.) | Specific gravity (25° C.) |
|---|---|---|---|
| BX16-122A | 5 | 1.147 | 0.92 |

TABLE 5

(Metha)acryloxyalakyl silanes, made by Shin-Etsu Chemical Co., Ltd.

| Part Number | Structural formula | Compound Name |
|---|---|---|
| LS-2080 | $CH_2{=}C(CH_3)CO(CH_2)_3SiCl_2$ | 3-methacryloxypropyl dichloromethyl silane |
| LS-2826 | $CH_2CHCO(CH_2)_3Si(CH_3)(OCH_3)_2$ | 3-acryloxypropyl dimethoxymethyl silane |
| LS-2827 | $CH_2{=}CHCO(CH_2)_3Si(OCH_3)_2$ | 3-acryloxypropyl trimethoxy silane |
| LS-3375 | $CH_2{=}C(CH_3)CO(CH_2)_3Si(CH_3)(OCH_3)_2$ | 3-methacryloxypropyl dimethoxymethyl silane |
| LS-3380 | $CH_2{=}C(CH_3)CO(CH_2)_3Si(OCH_3)_3$ | 3-methacryloxypropyl trimethoxy silane |
| LS-4548 | $CH_2{=}C(CH_3)CO(CH_2)_3Si(CH_3)(OC_2H_5)_2$ | 3-methacryloxypropyl diethoxymethyl silane |
| KS-5118 | $CH_2{=}C(CH_3)CO(CH_2)_3Si(OC_2H_6)_3$ | 3-methacryloxypropyl triethoxy silane |

These silicon-containing compounds may be used alone or in a combination of two or more, and also other compounds containing no silicon and having a carbon-carbon double bond may be used.

Also, these silicon-containing compound having a polymerizable carbon-carbon double bond and other compound containing no silicon and having a polymerizable carbon-carbon double bond are preferable used as a monomer, an oligomer or a mixture of a monomer and an oligomer.

The other compound having a polymerizable carbon-carbon double bond to be blended with the silicon-containing compound having a polymerizable carbon-carbon double bond is not particularly limited, but is preferable to be a monomer, an oligomer or a mixture of a monomer and an oligomer. As the oligomer are preferable 2-20 mers.

As the (metha)acrylate monomer or oligomer may be mentioned, for example, urethane-based (metha)acrylate, epoxy-based (metha)acrylate, ether-based (metha)acrylate, polycarbonate-based (metha)acrylate, fluorine-based (metha)acryl monomer or oligomer and so on.

The (metha)acrylate oligomer may be synthesized by reacting a compound such as polyethylene glycol, polyoxypropylene glycol, polytetramethylene ether glycol, bisphenol A-type epoxy resin, phenol novolac type epoxy resin, addition product of polyhydric alcohol and ϵ-caprolactone or the like with (metha)acrylic acid, or by urethanation of a polyisocyanate compound and a hydroxyl group-containing (metha)acrylate compound.

The urethane-based (metha)acrylate oligomer is obtained by urethanation of a polyol, an isocyanate compound and a hydroxyl group-containing (metha)acrylate compound.

As an example of the epoxy-based (metha)acrylate oligomer may be any reaction products between a glycidyl group-containing compound and (metha)acrylic acid. Among them, a reaction product between a glycidyl group-containing compound having a cyclic structure such as benzene ring, naphthalene ring, spiro ring, dicyclopentadiene, tricyclodecane or the like and (metha)acrylic acid is preferable.

Further, the ether-based (metha)acrylate oligomer, ester-based (metha)acrylate oligomer and polycarbonate-based (metha)acrylate oligomer may be obtained by reacting the respective polyol (polyether polyol, polyester polyol and polycarbonate polyol) with (metha)acrylic acid.

Moreover, various additives may be added in proper amounts to the ultraviolet-curing type resin or electron beam curing type resin constituting the resin layer 4, if necessary.

Furthermore, it is preferable to disperse fine particles into the resin layer 4, whereby fine unevenness can be formed on the surface of the resin layer 4 to ensure a transporting force of toners carried on the outer peripheral surface to the latent image support.

As the fine particle are preferable fine particles of rubber or synthetic resin, and carbon fine particles. Concretely, one or more of silicone rubber, acrylic resin, styrene resin, acryl-styrene copolymer, fluorine resin, urethane elastomer, urethane acrylate, melamine resin and phenolic resin are preferable.

The amount of the fine particles added is 0.1-100 parts by weight, preferably 5-80 parts by weight per 100 parts by weight of the resin.

The average particle size a of the fine particles is 1-50 μm, particularly 3-20 μm. Also, the thickness b of the resin layer dispersing the fine particles therein is preferably 1-50 μm. The ratio a/b of the average particle size a (μm) of the fine particles to the thickness b (μm) is preferable to be 1.0-5.0. When the ratio a/b is within the above range, a proper fine unevenness can be formed on the surface of the resin layer 4.

As the method of forming the resin layer 4 made from the ultraviolet-curing type resin or electron beam curing type resin, there is preferably adopted a method wherein a solution of a composition containing the above resin component, electrically conducting agent and other additives is applied onto the surface and then exposed to an irradiation of a ultraviolet ray in case of the ultraviolet-curing type resin or an electron beam in case of the electron beam curing type resin. The solution is preferable to contain no solvent, or a solvent having a high volatility at room temperature may be used as a solvent.

As the method of applying the solution, there can be used a method properly selected from a dipping method wherein a developing roller having no resin layer is immersed in the resin solution, a spray coating method, roll coating method and the like in accordance with the situation.

In case of using the ultraviolet-curing type resin, as a light source for irradiating the ultraviolet ray can be used anyone of a mercury lamp, a high pressure mercury lamp, a super-high pressure mercury lamp, a metal halide lamp, a xenon lamp and the like. The conditions for the irradiation of the ultraviolet ray may be properly selected in accordance with the kind and applying amount of the ultraviolet-curing type resin, but are suitable to be an illumination intensity of 100-700 $mW/cm^2$, an accumulated light quantity of about 200-3000 $mJ/cm^2$.

The thickness of the resin layer 4 is not particularly limited, but is usually 1-500 μm, preferably 3-200 μm, more preferably 5-100 μm. When the thickness is less than 1 μm, the charging performance of the surface layer may not be sufficiently ensured due to the friction in the use over a long time of period, while when it exceeds 500 μm, the surface of the developing roller becomes hard to give damages to the toner and hence the fixation of the toners to an image forming body such as a photosensitive body or the like or the stratification blade may be caused to form a poor image.

It is preferable to arrange a semiconductive elastic layer 3 between the shaft member 2 and the resin layer 4 (innermost resin layer when the resin layer 4 is comprised of plural layers). In this case, as the elastomer is used an elastomer itself or an elastic body formed by foaming the elastomer and adding an electrically conducting agent to the foamed body for giving an electric conducting property. The elastomer usable in the invention is not particularly limited, but includes nitrile rubber, ethylene-propylene rubber, styrene-butadiene rubber, butadiene rubber, isoprene rubber, natural rubber, silicone rubber, urethane rubber, acryl rubber, chloroprene rubber, butyl rubber, epichlorohydrin rubber and the like. These elastomers may be used alone or in a combination of two or more. In the invention, ethylene-propylene rubber, butadiene rubber, silicone rubber and urethane rubber are preferably used. Particularly, the resin having a urethane bond is preferably used in the invention.

Also, the elastomer can be used as a foamed body obtained by chemically foaming with water of a foaming agent or by mechanically blowing air to conduct foaming as a polyurethane foam.

In the formation of the elastic layer 3, a reaction injection molding process (RIM process) may be used in the step of integrally shaping the shaft member 2 and the elastic layer 3. That is, two monomer components constituting the raw material for the elastic layer 3 are mixedly injected into a cylindrical mold to conduct polymerization reaction to thereby integrally unite the shaft member 2 and the elastic layer 3. Thus, the shaping step can be carried out for a time required from the injection of the raw material to the demolding of about 60 seconds, so that it is possible to largely reduce the production cost.

As the electrically conducting agent to be compounded in the semiconductive elastic layer 3 can be used the same electrically conducting agents as compounded in the resin layer. Moreover, although the carbon-based material is essential as the electrically conducting agent compounded in the resin layer, the electrically conducting agent to be compounded in the elastic layer is not necessarily the carbon-based material, but may be the ionic electrically conducting agent, the electron electrically conducting agent other than the carbon-based material or a mixture thereof.

The semiconductive elastic layer 3 is not particularly limited, but is preferable to have a volume resistivity of $10^3$-$10^{10}$ Ωcm, particularly $10^4$-$10^8$ Ωcm. When the volume resistivity is less than $10^3$ Ωcm, there is a case that electric charges leak to the latent image support or the developing roller itself is broken by an applied voltage, while when the volume resistivity exceeds $10^{10}$ Ωcm, the sufficient developing bias can not be ensured and hence the fogging is easily caused.

In the elastic layer 3 may be added a crosslinking agent and a vulcanizing agent for rendering the elastomer into a rubbery substance, if necessary. In this case, there can be used a vulcanization assistant, a vulcanization accelerator, an accelerator activator, a retarder and the like even in any case of organic peroxide crosslinking and sulfur crosslinking. Furthermore, there may be added a peptizer, a blowing agent, a plasticizer, a softening agent, a tackifier, an anti-tack agent, a separator, a releasing agent, a thickening agent, a coloring agent and the like usually used as a compounding agent for rubber.

The hardness of the elastic layer 3 is not particularly limited, but is preferable to be not more than 80 degrees, particularly 30-70 degrees as an Asker C hardness. When the hardness exceeds 80 degrees, the function inherent to the elastic layer mitigating stress applied to the developing roller or toner is hardly developed and there is a fear that the contact area between the developing roller and the latent image support becomes small and the good development can not be conducted. Also, the toners are damaged to cause the adhesion of the toners to the photosensitive body or the stratification blade or the like to thereby easily produce a poor imaging. Inversely, when the hardness is too low, the friction force to the photosensitive body or stratification blade becomes large and there is a fear of causing a poor imaging such as jitter or the like.

Since the elastic layer 3 is used so as to push onto the photosensitive body or the stratification blade, even if the hardness is set to a low hardness, it is preferable that the compression permanent strain is made small as far as possible, and concretely it is not more than 20%.

The surface roughness of the elastic layer 3 is not particularly limited, but it is preferable to be not more than 15 μmRz, particularly 1-10 μmRz as a JIS 10-point average roughness. When the surface roughness exceeds 15 μmRz, there is caused a case of damaging the layer thickness or charging uniformity of the toner layer in a one-component developer (toner), but when it is not more than 15 μmRz, the adhesion property of the toner can be improved and also the deterioration of the image due to the abrasion of the roller in the use for a long time can be more surely prevented.

In order to obtain an adequate roughness, the surface of the elastic layer 3 may be polished, but the presence of the polishing step considerably lowers the productivity and brings about the increase of the cost. Therefore, it is preferable that the mold is used so as to optimize the surface roughness of the mold in the shaping of the elastomer.

The developing roller according to the invention is preferable to have a volume resistivity of $10^3$-$10^{10}$ Ωcm, particularly $10^4$-$10^8$ Ωcm. When the volume resistivity is less than $10^3$ Ωcm, the gradient control is very difficult and if defects are existent in the imaging body such as photosensitive body or the like, a bias leak may be caused. While, when the volume resistivity exceeds $10^{10}$ Ωcm, if the toners are developed on the latent image support such as photosensitive body or the like, the voltage drop is caused because the resistance of the developing roller itself as a toner support becomes high and hence the developing bias suitable for the development can not be ensured and the sufficient imaging concentration can not be obtained. Moreover, such a resistance value can be measured from a current value when an outer peripheral surface of the developing roller is pushed onto a flat plate-shaped or cylindrical opposite electrode under a predetermined pressure and a voltage of 100 V is applied between the shaft member 2 and the opposite electrode.

Thus, the feature of adequately and uniformly controlling the resistance value of the developing roller is important in a point that an electric field for moving the toners is kept adequately and uniformly. In addition to such a resistance value, it is important to rationalize and uniformize the toner charging amount by controlling and uniformly keeping the charge keeping ability on the surface of the developing roller and further attenuating the surface residual potential at a constant rate. In the latter case, the surface charge keeping ability is usually examined by arranging a pair of electrodes on the surface of the developing roller and applying a constant voltage between the electrodes to measure a surface resistance, but the current flows not only the surface but also the inside of the developing roller, so that the accurate evaluation on the surface of the developing roller can not be attained.

Also, the improvement of the precision by four-terminal method is proposed. However, in case of the lamination type developing roller, the surface layer is fairly thin, so that it is difficult to evaluate only the characteristics of only the surface even in this method. Therefore, the characteristic values obtained by these conventional measuring methods can not accurately represent the surface charge keeping ability.

As a first preferable countermeasure for such a problem, the surface charge keeping ability is evaluated by an absolute value of a surface potential attenuating rate from 0.1 second to 0.2 second after the application of charge when a voltage of 8 kV is applied to a corona discharger arranged at an interval of 1 mm from the surface of the developing roller under a measuring environment of 22° C. and 50% RH to generate corona discharge and cause the charging on the surface, in which the absolute value of the surface potential attenuating rate is preferable to be not less than 0.1 [V/sec].

When the value of the surface potential attenuating rate is less than 0.1 [V/sec], the surface charge successively stores in the continuous operation and the toner charging amount on the developing roller exceeds a predetermined value, i.e. the effective developing bias in the formation of the image through the developing process exceeds a potential in a white portion of the photosensitive body and hence a high voltage fogging to the white printed portion is caused. In some cases, the electric field generated by the toner charging exceeds a maximum value to cause the discharge to the latent image support such as photosensitive body or the like and there may be cause the poor imaging. Moreover, the polarity charged by the corona discharge may be positive or negative, In the invention, the value of the surface potential attenuating rate through the corona charging is sufficient to be not less than 0.1 [V/sec]. More preferably, the value of the surface potential attenuating rate is 0.15-10 [V/sec].

Figure 7:
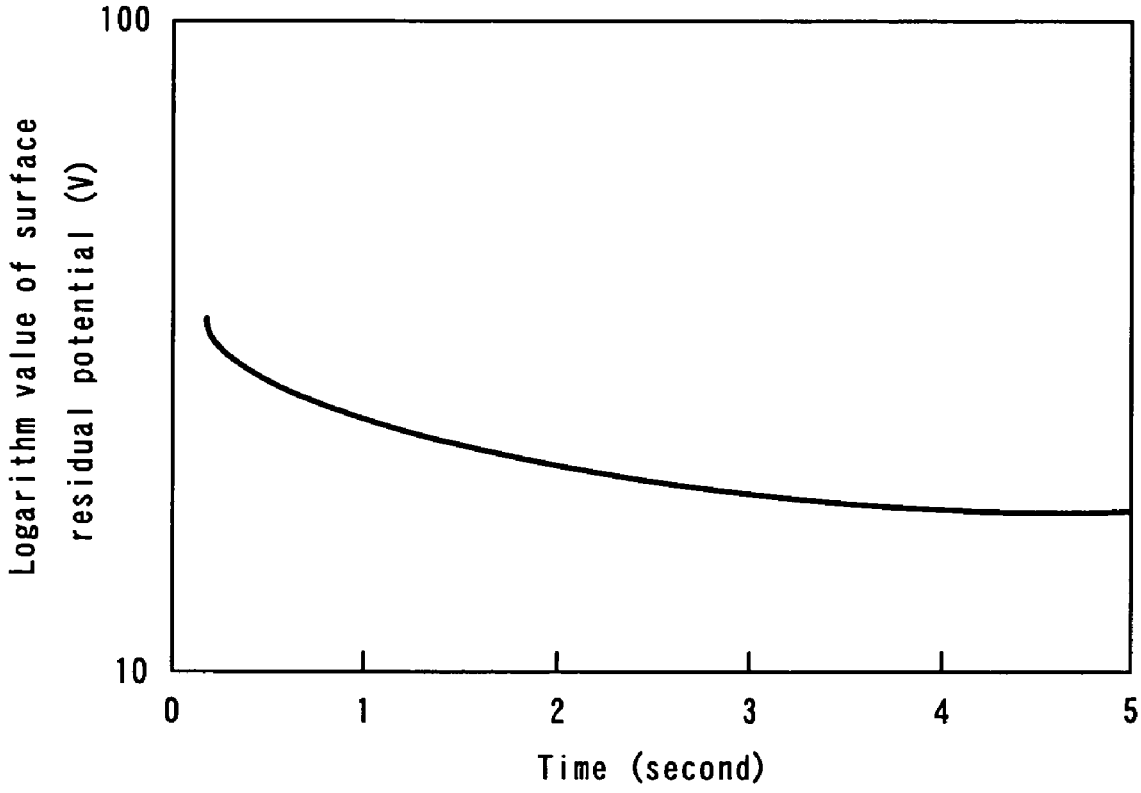
FIG. 7 is a graph showing an attenuation of logarithmic values of surface residual potential.

Next, the attenuation of the potential on the surface of the developing roller will be described simply. In general, the potential attenuating curve leads to a linear relation when plotting a logarithm log V of time t[sec] to surface potential, from a gradient of this linear curve it is possible to set a mitigating time (time constant). However, the attenuation curve in the actual developing roller can not be the linear relation as shown in FIG. 7. This is considered due to the act that the attenuation time constant is shows a dependency of the residual surface potential on the voltage. At this moment, the rotating peripheral speed of the developing roller is about 0.4 sec/one rotation in many cases, and the charge attenuating speed at a very short time is considered to be an important feature. Also, a time from the pass through the stratification blade to a scraping with a roller for toner application is about 0.2 second, so that the surface potential attenuating rate after 0.2 second of the surface charging becomes particularly an important characteristic.

In the aforementioned countermeasure, a non-contact corona charging is used as a means for giving a given charge to the surface of the developing roller, and it is difficult to identify an initial charging potential V=0 in this charging system. In the actual measurement, therefore, the attenuating rate [V/sec] from 0.1 second to 0.2 second is measured to control the attenuating rate. As a calculation method of the attenuating rate, there can be adopted a method wherein the surface potential after 0.1 second is an initial value and a value of the surface potential after 0.2 second is approximated to a linear line by a least-square method and the surface potential attenuating rate is determined from a gradient thereof.

Figure 4:
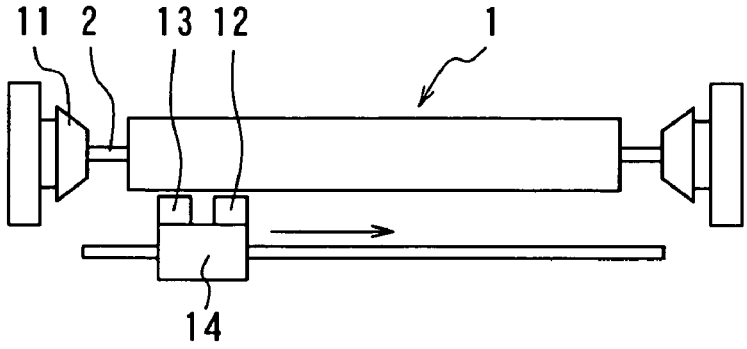
FIG. 4 is a schematic view of an apparatus for the application of electric charge to a developing roller and the measurement of surface potential.
Figure 5:
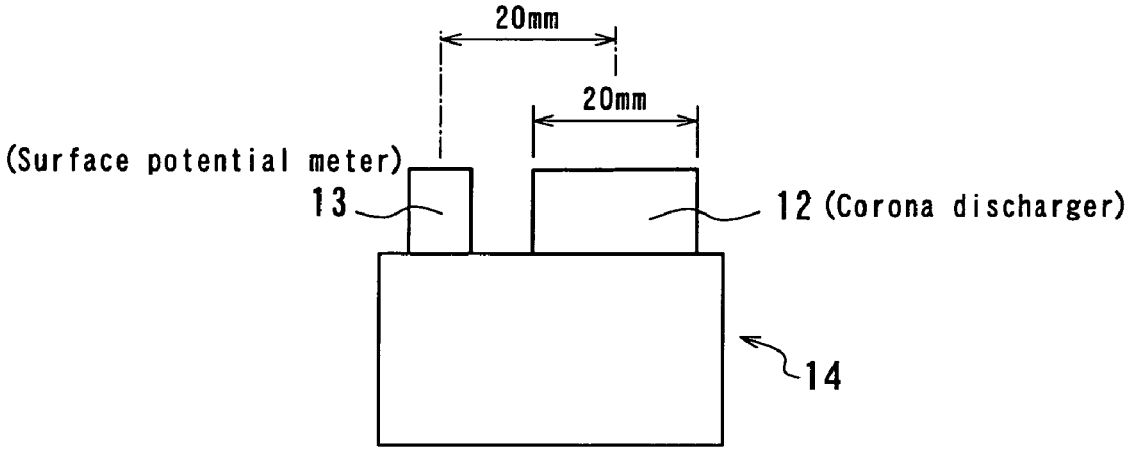
FIG. 5 is a schematic view illustrating arrangements of a surface potential meter and a discharger on a measuring unit.

The application of charge to the developing roller and the measurement of the surface potential can be conducted by an apparatus shown, for example, in FIG. 4. That is, there is preferable adopted a method wherein both end portions of the shaft member 2 in the developing roller 1 are grasped by a chuck 11 to support the developing roller 1, and a measuring unit 14 provided with a small-size corotron discharger (corona discharger) 12 and a surface potential meter 13 arranged at a given interval as shown in FIG. 5 is disposed opposite to the surface of the developing roller 1 at an interval of 1 mm, and then the measuring unit 14 is moved at a constant speed from one end to the other end in the longitudinal direction of the developing roller in resting state of the developing roller to measure the surface potential while applying a surface charge.

In order to realize the developing roller having a surface potential attenuating rate of not less than 0.1 [V/sec], it is preferable that the value of the surface potential attenuating rate of the aforementioned resin layer is not less than 0.1 [V/sec]. Also, even if the value of the surface potential attenuating rate is less than 0.1 [V/sec], the thickness of the resin layer is thinned, for example, to 3-10 μm, whereby the developing roller having a surface potential attenuating rate of not less than 0.1 [V/sec] can be realized.

As a second countermeasure on the above problem, the surface charge keeping ability is preferably evaluated by a maximum value of the surface potential after 0.35 second when a voltage of 8 kV is applied to a corona discharger arranged at an interval of 1 mm from the surface of the developing roller under a measuring environment of 22° C. and 50% RH to generate corona discharge and cause the charging on the surface, in which the maximum value is not more than 90 V, more preferably not more than 50 V. When the maximum value exceeds 90 V, the toners are fed to the image forming body and the electric charge retains in the toner feeding portions when the toners are removed from the surface of the developing roller, and hence the toner charging amount charged in the same portion becomes lower. Also, the scattering of the effective developing bias is caused by a potential generated from the residual charge and the toner developing amount is non-uniform and hence a possibility of causing the uneven image becomes high. Further, when the developing roller is continuously rotated without feeding the toners to the latent image support, the toner charge gradually increases, and the electric field generated by the toner charging exceeds the maximum value as the case may be, and hence the discharge to the latent image support such as photosensitive body or the like may be caused to produce a poor imaging.

The reason why the measurement of the surface potential is carried out after 0.35 second from the charging due to the generation of corona discharge is as follows. That is, it is difficult to measure the surface potential just after the charging by the corona discharge, and an extremely initial surface potential is unstable, so that it is it is not preferable to control this characteristic value at this portion. Considering the actual process in the formation of the image by the development or the like, when the developing roller is, for example, a roller form, the rotating speed is usually 0.35 sec/one rotation, so that it is sufficient to conduct the control of the residual charge on the surface at this time.

The measurement of the maximum surface potential of the developing roller can be carried out, for example, by the apparatus shown in FIG. 4 as previously mentioned.

In the invention, it is preferable that the maximum surface potential measured in the same manner as mentioned above is not more than 150 V, particularly not more than 90 V on the resin layer formed by applying the ultraviolet-curing type resin composition or electron beam curing type resin composition forming the resin layer onto a one-side surface of a metal plate such as steel plate, SUS or the like so that a thickness after curing is 30 μm and irradiating the ultraviolet ray or the electron beam to conduct the curing. In order to render the maximum surface potential of the resin layer into not more than 150 V, the ultraviolet-curing type resin or the electron beam curing type resin composition may be compounded, for example, with a proper amount of a proper electrically conducting agent.

In order to realize the developing roller having a maximum surface potential of not more than 90 V, it is preferable that the maximum surface potential of the aforementioned resin layer is not more than 150 V. Also, even if the maximum surface potential exceeds 150 V, the thickness of the resin layer is thinned to, for example, 3-10 μm, whereby the developing roller having a maximum surface potential of not more than 90 V can be realized.

In addition to the feature that the resistance value of the developing roller is controlled properly and uniformly as mentioned above, it is important to cope with the following problem. Recently, the demand for the imaging property becomes severer with the increase of the speed in the printer or the like, improvement of fine imaging property required, formation of colored image and the like, and hence there are emerged various problems which can not be solved in the conventional developing roller. Particularly, the increase of toner damage due to the high speed is treated as a serious problem causing the poor imaging such as fogging or the like due to poor toner charging when the developing roller is used for a long time. As to the durability of the developing roller, the filming or fused and adhered toner aggregate due to the toner damage polishes or abrades the developing roller or the contact part with the developing roller and hence there may be caused a problem of inducing the toner leakage or the like. Therefore, it is demanded to cope with such problems.

As a countermeasure for the toner leakage due to the abrasion of the developing roller, it is a fundamental solution to prevent the filming or fused adhesion of the toner. Recently, from a viewpoint of the energy saving, it tends to shift the glass transition point of the toner to a lower level, and the solution of the above problem becomes more difficult. Under such a situation, it is considered that a design idea of eliminating the occurrence of the toner aggregate as far as possible is important as a countermeasure from the side of the developing roller.

Considering the above situation, the applicants have proposed a developing roller capable of suppressing the polishing of the developing roller generated by the toner aggregate due to the toner damage, preventing the occurrence of troubles such as toner leakage and the like and providing stable and good images under a use environment such as long-period storing, a long-period use or the like, which caused poor imaging in the conventional technique, and an imaging apparatus using such a developing roller as disclosed in JP-A-2002-40801.

In general, the abrasion of the developing roller is caused due to the fact that the toner aggregate penetrates into a press contacting portion between the developing roller and a sealant of a toner cartridge and always promotes the polishing in the working of the developing roller. In the static operation of the developing roller, the deformation is caused in the press contacted portion and a fine gap resulted from the residual deformation is generated to the sealant just after the operation of the developing roller, and hence the toners penetrate thereinto to form the toner aggregate through the press contacting and friction.

When the developing roller shows a plastic deformation behavior above a certain standard value, the probability of generating the above fine gap becomes higher and the penetration of the toner aggregate into the press contacted portion is promoted.

In the developing roller having a coating layer comprising the elastic layer and one or more layers formed on the outside of the elastic layer directly or through other layer, therefore, the surface properties of the developing roller are adjusted to such a value that a particular creep value obtained by the measurement of deformation recovering behavior on the surface under constant loading condition in the measurement of universal hardness is within a particular range, whereby the penetration of the toner aggregate between the developing roller and the sealant is suppressed and the abrasion of the developing roller and the toner leakage accompanied therewith are prevented, and hence there can be provided the stable and good image under a use environment such as long-period storing, a long-period use or the like, which caused poor imaging in the conventional technique.

That is, the measurement of the universal hardness is carried out by pushing a square or triangular pyramid-shaped penetrator onto a mass to be measured under a given testing load and measuring a surface area of the penetrator with the mass from a pushing depth and determining a universal hardness from the measured surface area and the testing load. In this case, after the penetrator is pushed onto the mass to be measured under a constant loading condition, such a constant loading condition is kept and then the load of the penerator is gradually decreased, whereby a position difference of the penetrator between initial measurement and measurement end generated by the plastic deformation of the mass can be determined. For example, when a constant load is 100 $mN/mm^2$ and a time keeping such a constant load (creep time) is 60 seconds, the above difference is called as "60-second creep value under constant loading condition of 100 $mN/mm^2$". This creep value is obtained by causing the plastic deformation of the developing roller through the above measurement of deformation recovering behavior, which can standardize the degree of the penetration of the toner aggregate between the developing roller and the sealant and hence the degree of the abrasion of the developing roller by a value determined by the measurement of the universal hardness or the like using a commercially available hardness measuring device such as super-micro hardness meter H-100V made by Fischer Co., Ltd. or the like.

The developing roller and the imaging apparatus disclosed in JP-A-2002-40801 are designed based on the above knowledge. This developing roller is a developing roller in which toners are carried on the surface to form a toner thin layer and contacted with or approximated to a latent image support at this state to feed the toners onto the surface of the latent image support to thereby form a visualized image, characterized in that the 60-second creep value obtained from the deformation recovering behavior of the surface under the constant loading condition of 100 $mN/mm^2$ is not more than 10.0 μm in the measurement of the universal hardness on the surface of the developing roller, and the imaging apparatus comprises at least such a developing roller and the latent image support forming on its surface a visualized image by the toners fed from the developing roller.

Now, the developing roller is preferably constituted so as to suppress the plastic deformation of the developing roller and suppress the penetration of the toner aggregate between the developing roller and the sealant to thereby prevent the toner leakage by optimizing the 60-second creep value under the constant loading condition of 100 $mN/mm^2$ required in the measurement of the universal hardness on the outer peripheral surface of the developing roller.

The universal hardness is a physical value determined by pushing the penetrator onto the mass to be measured under a load and is determined by; (Testing load)/(surface area of penetrator under testing load) and represented by $N \cdot mm^2$ as a unit. The universal hardness can be carried out by using a commercially available hardness measuring device such as csuper-micro hardness meter H-100V made by Fischer Co., Ltd. or the like. In this measuring device, the square or triangular pyramid-shaped penetrator is pushing onto the mass to be measured, and when it arrives at a given pushing depth, the surface area of the penetrator is measured from this pushing depth, from which the universal hardness is determined by the above equation.

In such a measurement of the universal hardness, the penetrator is pushed onto the mass to be measured while gradually increasing the pushing load of the penetrator to a given load, and thereafter such a constant loading environment is kept and then the load of the penetrator is decreased, whereby a residual difference through the deformation of the surface of the mass to be measured (creep value) can be determined. That is, if the mass to be measured is a complete elastomer, when the load is increased to push the penetrator onto the mass to be measured and thereafter the load of the penetrator is decreased, the surface of the mass to be measured returns to the original state, so that the penetrator returns to the original position, i.e. the position corresponding to the pushing depth of zero. Inversely, if the mass to be measured is a complete plastic body, even when the load is removed after the pushing of the penetrator, the surface of the mass to be measured keeps a state of pushing the penetrator, and hence the penetrator never returns to the original position. Utilizing this fact, the plastic deformation amount of the mass to be measured can be determined from the difference of the position between the measuring start and the measuring end at a standardized state under any measuring condition.

In the developing roller 1, it is preferable that the 60-second creep value obtained by the measurement of the deformation recovering behavior on the outer peripheral surface of the developing roller under the constant loading condition of 100 $mN/mm^2$ in the above measurement of the universal hardness is adjusted to not more than 10.0 μm. For example, the surface of the developing roller may be adjusted to the value of 0.1-10.0 μm, preferably not more than 8.5 μm.

Moreover, the conditions in the measurement of the creep value are not particularly limited except for the maximum load and creep time at the maximum load, and can be properly set in accordance with the form of the penetrator, the measuring device and the like. Even if the maximum load is changed, the specified value of the creep value is properly corrected, which is applicable as an evaluation standard. In case of targeting a toner binder usually used (styrene-acrylonitrile copolymer resin or a polyester resin), it is possible to conduct the standardization under the above conditions. For example, when the measurement is carried out by using a using a commercially available hardness measuring device such as super-micro hardness meter H-100V made by Fischer Co., Ltd., there can be mentioned the following conditions. That is, the creep value can be calculated through a computer by pushing the penetrator onto the developing roller under the following conditions and keeping the given conditions for about 60 seconds and removing the load.

The measuring conditions are:

penetrator: square pyramid type diamond having a face-to-face angle of 136 degrees;

initial load of penetrator: 0.02 $mN/mm^2$;

maximum load: 100 $mN/mm^2$;

load applying rate: 100/60 $mN/mm^2/sec$;

creep time at maximum load: 60 sec.

In addition to the above issues, it is an important issue to provide a developing roller which provides an image of a higher quality and does not cause poor imaging such as fogging of white image, roughing of half-tone image, grayscale unevenness of black image or the like.

For this end, in the developing roller 1, it is preferable that the universal hardness at a state of rendering the pushing depth into 5 μm under the measuring condition of 100 $mN/mm^2/60$ seconds to the outer peripheral surface of the roller, i.e. a state of deforming the outer surface of the roller inward by only 5 μm is not more than 3 $N/mm^2$.

The universal hardness is a physical value determined by pushing the penetrator onto the mass to be measured under a load and is determined by; (Testing load)/(surface area of penetrator under testing load) and represented by $N \cdot mm^2$ as a unit. The universal hardness can be carried out by using a commercially available hardness measuring device such as csuper-micro hardness meter H-100V made by Fischer Co., Ltd. or the like. In this measuring device, the square or triangular pyramid-shaped penetrator is pushing onto the mass to be measured, and when it arrives at a given pushing depth, the surface area of the penetrator is measured from this pushing depth, from which the universal hardness is determined by the above equation. That is, a stress to the pushed depth when the penetrator is pushed onto the mass to be measured under the constant loading condition is defined as the universal hardness.

In the developing roller 1, therefore, it is preferable to adjust the surface of the developing roller so that the universal hardness is not more than 3 $N/mm^2$ under the above universal hardness measuring condition of 100 $mN/mm^2/60$ seconds, more preferably 0.1-3 $N/mm^2$, particularly 0.1-1.5 $N/mm^2$.

The developing roller 1 according to the invention is preferable that the universal hardness in the vicinity of the surface, preferably in a region from the surface within 5 μm under the above-defined measuring condition (i.e. constant load applying rate in the measurement of the universal hardness 100/60 ($mN/mm^2/sec$)) is not more than 3 $N/mm^2$ as mentioned above. When the universal hardness exceeds 3 $N/mm^2$, the deterioration of the toner is large and it is difficult to obtain a high-quality image stabilized over a long time of period.

That is, the universal hardness measured under the above condition is an indicator directly evaluating the hardness in the region of the developing roller 1 from the outer peripheral surface within 5 μm, which is very effective for judging the properties of the developing roller.

Although the Asker C hardness, JIS A hardness, Micro Hardness and the like usually used measure stress in a relatively large deformation, the universal hardness defined herein shows a stress when the surface is deformed by only 5 μm at most. Since the average particle size of the toner used in the non-magnetic developing process is about 4-10 μm, the toners are pushed onto the surface of the developing roller by the stratification blade arranged at a slight gap from the surface of the developing roller, and hence the surface of the developing roller is deformed in correspondence with the average particle size of the toner. If the stress in the surface of the developing roller based on such a deformation is large, stress given to the toner also becomes large and the deterioration of the toners retaining in the developing roller is caused after the use over a long time of period to produce an inconvenience not supporting a normal toner charging performance, and hence the image fogging, lowering of printing concentration and the like are caused to damage the quality of the image. In the invention, the stress when the surface of the developing roller is deformed only by 5 μm is made to the aforementioned value for the purpose of lowering the stress at the slight deformation, whereby the deterioration of the toner can be suppressed.

Figure 8:
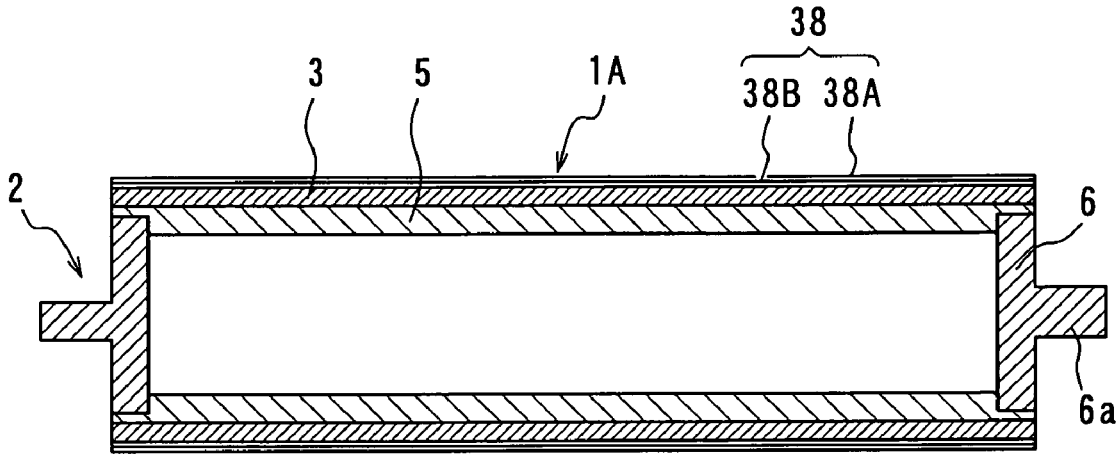
FIG. 8 is a diagrammatically section view of a modified embodiment of the developing roller.

A modified embodiment of the invention will be described below. FIG. 8 is a section view of a modified embodiment of the developing roller. In such a developing roller 1A, a semiconductive elastic layer 3 is formed on an outer periphery of a shaft member 2 and further a semiconductive resin layer 38 is formed on the elastic layer 3, but the presence of the elastic layer 3 is not an essential feature. The shaft member 2 comprises a hollow cylindrical metal pipe 5 and a shaft-mounted cap 6 attached to each end of the metal pipe 5, in which a shaft part 6*a* constituting a longitudinal end portion of the shaft member 2 is arranged on the shaft-mounted cap 6 and born by a roller supporting portion of an imaging apparatus not shown.

The shaft member 2 has a good electric conductivity because of a metal. The metal material used in the shaft member 2 is not particularly limited, but may include, for example, iron, stainless steel, aluminum and alloys containing them. It may be the same construction as in the previously mentioned embodiment.

In the developing roller 1A of the modified embodiment, the resin layer 38 is constituted with two layers adjoining to each other inside and outside in the radial direction, in which a first resin layer 38B located inside in the radial direction has a volume resistivity of not more than $10^6$ Ω·cm and a second resin layer 38A located outside in the radial direction has a volume resistivity of not less than $10^{10}$ Ω·cm.

At least one layer of these resin layers 38A, 38B is constituted with an electrically conducting agent-containing ultraviolet-curing type resin or electron beam curing type resin capable of curing through an irradiation of a ultraviolet ray or an electron beam for making useless a large-scale drying line, which is required in case of using a thermosetting resin as a resin, in the production step of applying a solution of a resin constituting the resin layer and thereafter curing it.

As to this modified embodiment, the construction other than the resin layer comprising the first resin layer 38B and the second resin layer 38A is the same as in the previously mentioned embodiment, and the detailed explanation is omitted here.

Figure 9:
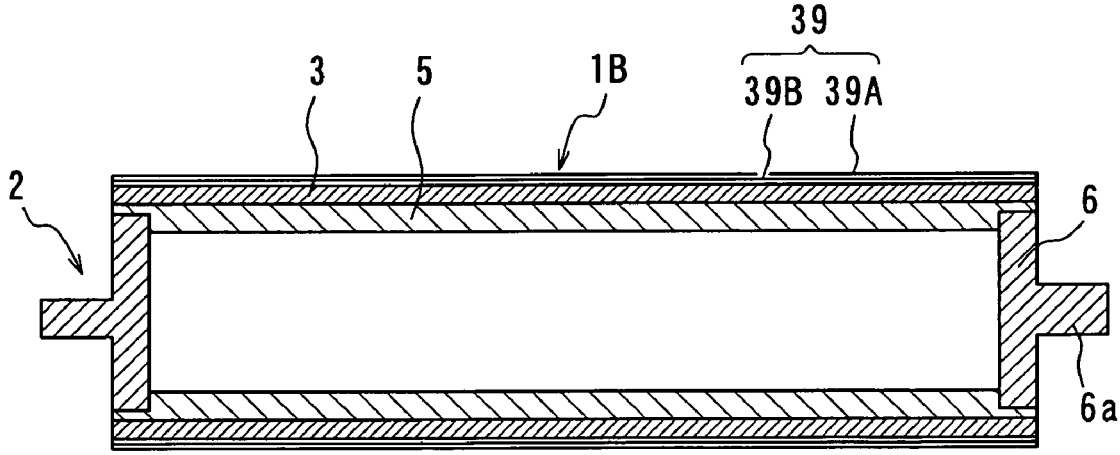
FIG. 9 is a diagrammatically section view of the developing roller according to another embodiment of the invention.

The other embodiment of the invention will be described below. FIG. 9 is a section view of the developing roller according to this embodiment. In the developing roller 1B, a semiconductive elastic layer 3 is formed on an outer periphery of a shaft member 2 and further a semiconductive resin layer 39 is formed on the elastic layer 3, but the presence of the elastic layer 3 is not an essential feature. The shaft member 2 comprises a hollow cylindrical metal pipe 5 and a shaft-mounted cap 6 attached to each end of the metal pipe 5, in which a shaft part 6*a* constituting a longitudinal end portion of the shaft member 2 is arranged on the shaft-mounted cap 6 and born by a roller supporting portion of an imaging apparatus not shown.

The shaft member 2 has a good electric conductivity because of a metal. The metal material used in the shaft member 2 is not particularly limited, but may include, for example, iron, stainless steel, aluminum and alloys containing them. It may be the same construction as in the previously mentioned embodiment.

The resin layer 39 may be constituted with one layer or plural layers having different materials or properties with each other. In this embodiment, it is constituted with two layers. FIG. 9 shows the developing roller in which the resin layer 39 is constituted with two layers, i.e. a first resin layer 39B located inside in the radial direction and a second resin layer 39A located outside in the radial direction.

At least one layer of these resin layers 39A, 39B is constituted with an electrically conducting agent-containing ultraviolet-curing type resin or electron beam curing type resin capable of curing through an irradiation of a ultraviolet ray or an electron beam for making useless a large-scale drying line, which is required in case of using a thermosetting resin as a resin, in the production step of applying a solution of a resin constituting the resin layer and thereafter curing it.

Also, the developing roller 1B shown in FIG. 9 is characterized in that fine particles are dispersed in the resin layer 39, whereby micro-unevenness is formed on the surface of the resin layer 39 and it is possible to ensure the transporting force of toners carried on the outer peripheral surface to the latent image support. Preferably, the resin layer 39 is comprised of two layers 39A, 39B and the fine particles are dispersed into only the first resin layer 39B located inside in the radial direction, while the fine particles are not dispersed into the second resin layer 39A located in the radial direction. Thus, the file particles in the first resin layer 39B can give the desired surface roughness to the developing roller, and further the action of the second resin layer 39A can prevent the exposure of the fine particles in the first resin layer 39B to the surface of the developing roller and the dropping off therefrom, and hence the desired surface roughness can be maintained over a long time of period.

As the fine particles are preferable fine particles of rubber or synthetic resin or carbon fine particles. Concretely, one or more of silicone rubber, acrylic resin, styrene resin, acryl/styrene copolymer, fluorine resin, urethane elastomer, urethane acrylate, melamine resin and phenolic resin are preferable.

The amount of the fine particles added is 0.1-100 parts by weight, preferably 5-80 parts by weight per 100 parts by weight of the resin.

The average particle size of the fine particles is preferable to be 1-50 μm, particularly 3-20 μm. Also, the total thickness b of the resin layer 4 is preferably 1-50 μm, and further the ratio a/b of the average particle size of the fine particles a (μm) to the total thickness b (μm) is preferable to be 1.0-5.0. When the ratio a/b is within the above range, an optimum fine unevenness can be formed on the surface of the resin layer 39.

Also, when the resin layer 39 is comprised of the first resin layer 39B dispersing the fine particles therein and the second resin layer 39A, the thickness of the second resin layer 39A is preferable to be 1-10 μm. Thus, the surface roughness formed by the fine particles in the first resin layer 39B is truly reflected on the surface of the developing roller, while it can be prevented that the fine particles in the first resin layer 39B are directly exposed from the surface of the developing roller.

In the resin layer 39 may be compounded an electrically conducting agent for the purpose of controlling the electric conducting property. When the resin layer 39 is comprised of the first resin layer 39B dispersing the fine particles therein and the second resin layer 39A, it is preferable that the volume resistivity of the first resin layer 39B is not more than $10^6$ Ω·cm and the volume resistivity of the second resin layer 39A is not less than $10^{10}$ Ω·cm.

As the electrically conducting agent to be compounded with the resin for the resin layers 39A, 39B are used an electron electrically conducting agent, an ionic electrically conducting agent and the like.

The construction of this embodiment including the ultraviolet-curing type resin or electron beam curing type resin other than the above is the same as mentioned in the previous embodiment, and the detailed explanation on the items are omitted herein.

Figure 1:
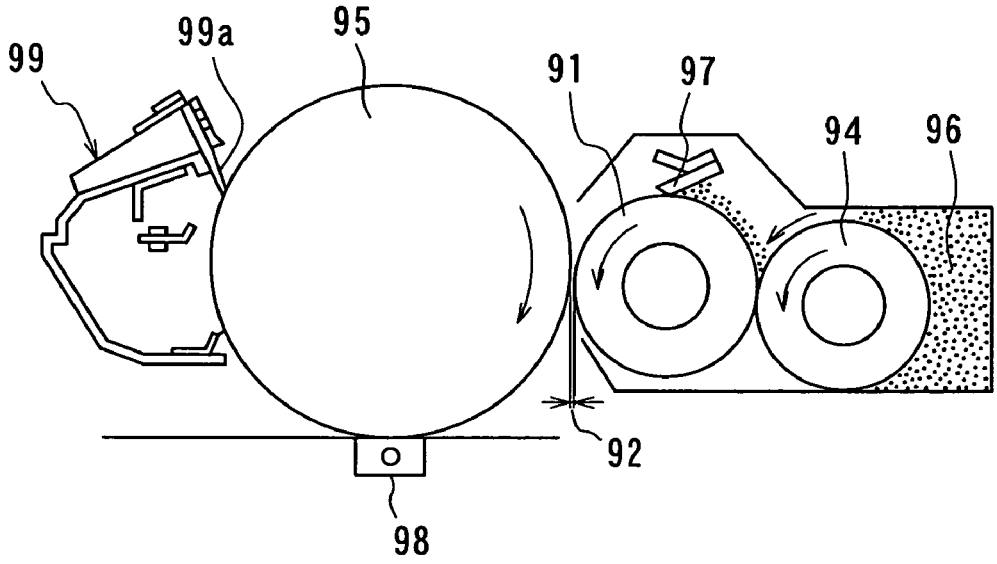
FIG. 1 is a schematic diagram of an imaging apparatus used in a non-magnetic jumping development process.
Figure 2:
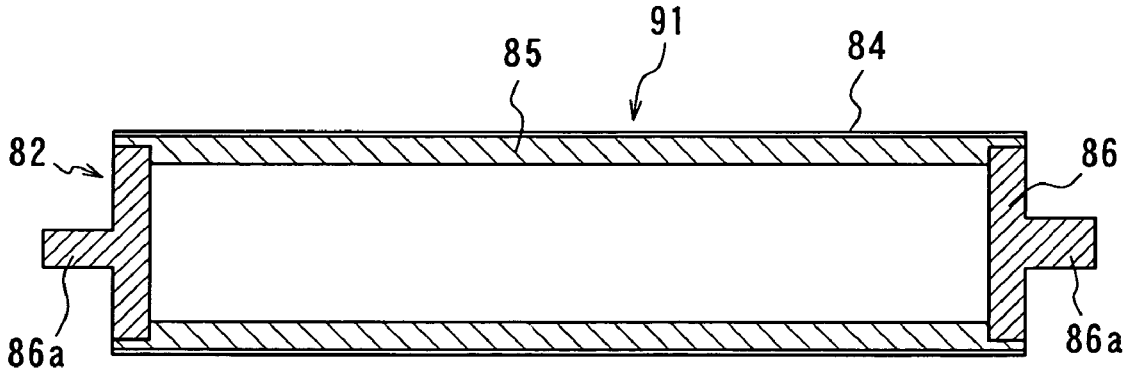
FIG. 2 is a section view of the conventional developing roller.

The developing rollers 1, 1A, 1B according to the invention can be built onto an imaging apparatus using the toners. Concretely, as shown in FIG. 1, a developing roller 91 is arranged between a toner feed roller 94 for feeding toners and a photosensitive drum (latent image support) 95 keeping a latent image at a slight gap 92 to the photosensitive drum 95, and these developing roller 91, photosensitive drum 95 and toner feed roller 94 are rotated in arrow directions, respectively, and a predetermined voltage is applied between the photosensitive drum 95 and the developing roller 91 to feed toners 96 onto the surface of the developing roller 91 through the toner feed roller 94 and align to a uniform thin layer through a stratification blade 97, and the toners 96 formed as the thin layer are jumped over the gap 92 to the photosensitive drum 95, whereby the latent image can be visualized. Moreover, the details of FIG. 1 are explained in the related art, and the explanation is omitted herein.

EXAMPLES

Next, the invention will be concretely explained with reference to the following examples and comparative examples, but the invention is not limited thereto.

In the examples, the developing roller having a structure shown in FIG. 3 is produced by directly forming the resin layer on the shaft member of aluminum pipe when the developing roller is not provided with the elastic layer, or by forming the elastic layer on the shaft member and thereafter forming the resin layer thereon when the developing roller is provided with the elastic layer. For the comparison with the developing roller of the example, there is prepared a developing roller having a construction partly different from that of the invention as a comparative example. With respect to the developing rollers of the examples and the comparative examples, the characteristics of the roller and the image are evaluated.

In a material table showing materials used for the formation of the resin layer and item-evaluation table showing the compounding recipe of the materials as well as the items and evaluation results of the developing roller, Examples 1a-13a and Comparative Examples 1a-3a are shown in Table 6 (material table) and Tables 7, 8 (item-evaluation table);

Examples 1b-1b and Comparative Examples 1b, 2n are shown in Table 9 (material table) and Tables 10, 11 (item-evaluation table);

Examples 1c-9c and Comparative Examples 1c-3c are shown in Table 12 (material table) and Tables 13, 14 (item-evaluation table);

Examples 1d-10d and Comparative Example 1d are shown in Table 15 (material table) and Tables 16, 17 (item-evaluation table);

Examples 1e-8e and Comparative Example 1e are shown in Table 18 (material table) and Tables 19, 20 (item-evaluation table);

Examples 1f-9f and Comparative Example 1f are shown in Table 21 (material table) and Tables 22, 23 (item-evaluation table);

Examples 1g-10g and Comparative Example 1g are shown in Table 24 (material table) and Tables 25, 26 (item-evaluation table); and Examples 1h-10h and Comparative Example 1h are shown in Table 27 (material table) and Tables 28, 29 (item-evaluation table), respectively.

In the formation of the resin layer, the materials in the material table corresponding to each of the examples and comparative examples are compounded in parts by weight shown "Compounding recipe (part by weight)" of the item-evaluation table, and the shaft member is immersed in a solution dissolving the compounded resin materials (dip process) or a paint of the compounded resin materials is applied with a roll coater (coater process), and thereafter the materials are thermoset (heating or air drying), cured through an ultraviolet ray, or cured through an electron beam.

As to the preparation of each sample, the application of the resin through dip process or coater process, and the curing treatment by thermosetting (heating or air drying), ultraviolet-curing or electron beam curing are described in a column of the item-evaluation table corresponding to the respective examples and comparative examples.

In the curing of the resin layer through the ultraviolet ray, the developing roller coated with the resin layer is rotated, while the ultraviolet ray is irradiated by using a device of Unicure UVH-0252C made by Ushio Inc, at an illumination intensity of 400 mW and an integrating light quantity of 1000 mJ/cm$^2$. Also when the resin is cured through the electron beam, the roller is rotated, while the electron beam is irradiated by using a device of Min-EB made by Ushio Inc, under conditions that an acceleration voltage is 30 kV, a tube current is 300 μA, an irradiation distance is 100 mm, a nitrogen atmosphere is 760 mmTorr, and an irradiating time is 1 minute.

The presence or absence of the elastic layer and the material for the elastic layer in the formation of the elastic layer are described in a column of "presence or absence-kind of elastic layer" of the item-evaluation table corresponding to the respective examples and comparative examples.

When the elastic layer is made from urethane, 1.0 part by eight of 1,4-butane diol, 1.5 parts by weight of a silicone surfactant, 0.5 part by weight of nickel acetylacetnate, 0.01 part by weight of dibutyltin dilaurate and 0.01 part by weight of sodium perchlorate are added to 100 parts by weight of polyether polyol obtained by addition reacting glycerin with propylene oxide and ethylene oxide and having a molecular weight of 5000 (OH value: 33) and mixed in a mixer to prepare a polyol composition. The polyol composition is defoamed with stirring under a reduced pressure and added with 17.5 parts by weight of a urethane-modified MDI and stirred for 2 minutes, and thereafter poured into a mold or a vessel provided with a shaft member and heated at 110° C. and cured for 2 hours, and then an outer periphery is polished to form an elastic layer having an outer diameter of 12 mm, a thickness in an elastic layer portion of 500 μm and a full length of 210 mm.

When the elastic layer is made from silicone, a liquid silicone rubber is injected into a cavity of a mold provided with a shaft member and cooled and cured in the mold to form an elastic layer having an outer diameter of 12 mm, a thickness in an elastic layer portion of 300 μm and a full length of 210 mm.

The toner charging amount and toner transporting amount in the item-evaluation table are determined as follows. That is, a cartridge provided with each of the developing rollers of the tables is built into an imaging apparatus and the developing roller is idled without printing, and thereafter the cartridge is taken out from the apparatus and the toners are introduced from the surface of the developing roller into a Faraday gauge to measure the toner charging amount. While, in the measurement of the toner charging amount, the weight of the toner removed is measured and the area of the surface portion of the developing roller after the removal of the toners is calculated, from which the toner weight per unit area is determined as a toner transporting amount.

Also, the evaluation of the image is carried out as follows. That is, the developing roller of each of the examples and comparative examples is mounted onto a commercially available printer having a developing unit portion of a non-magnetic jumping process shown in FIG. 1, and a developing bias voltage comprising an alternating current superimposed on a direct current is applied thereto, whereby a reverse jumping development is carried out using negative charged non-magnetic one-component toners having an average particle size of 7 μm. An "initial" in the image evaluation is represented by five-stage evaluation of judgment results when a full black image, a fill white image, a half tone image and a pattern image are printed just after the mounting of the developing roller and their printed qualities are visually judged every evaluation item in the table.

In the five-stage evaluation, 5 is "particularly good", 4 is "good", 3 is "acceptable level", 2 is "slightly bad" and 1 is "NG", in which the value above 3 is an acceptable level as a product.

Similarly, the judgment by five-stage evaluation of the printed images is carried out by changing an environment from low-temperature and low humidity (15° C.×10%) to high-temperature and high humidity (32° C.×85%), and the results are shown in a column of "Influence of environment change" (the larger the numerical value, the less the influence of environment).

Further, the image evaluation of "Durability after 10000 printing" is carried out in the same manner as in "initial" after the continuous printing of 10000 images having a 5% printing concentration.

Figure 6:
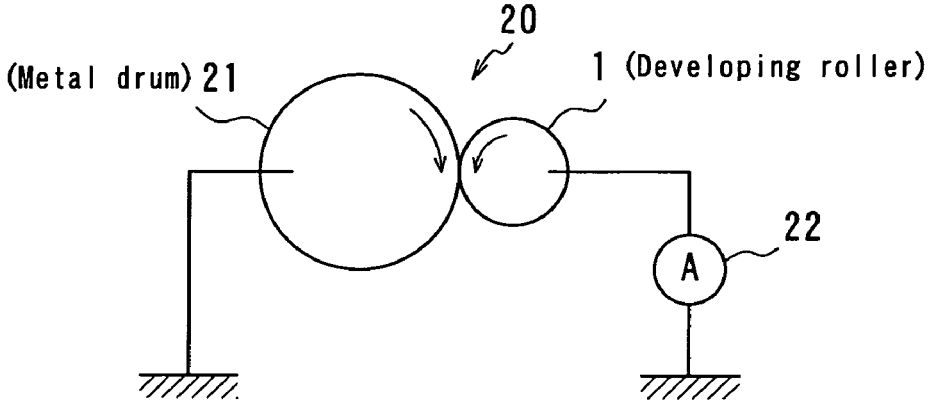
FIG. 6 is a schematic view of a rotary resistance measuring device.

With respect to the developing rollers, the resistance value is measured by using a rotary resistance measuring device shown in FIG. 6 and applying a voltage of 100 V between the roller and an opposed electrode (metal drum).

In Examples 1g-10g and Comparative Example 1g, the surface potential is measured up to 0.2 second by using a device shown in FIG. 4 and applying a voltage of 8 kV to the roller to charge the roller surface through corona discharge and moving a measuring unit 14 at a speed of 200 mm/sec. Moreover, the form and size of the measuring unit are shown in FIG. 5. According to this method, the measurement is carried out over a full of the roller surface to determine a surface potential attenuating rate from 0.1 second up to 0.2 second after the corona charging. Moreover, the measuring environment is controlled to a temperature of 22° C. and a humidity of 50%.

In Examples 1h-10h and Comparative Example 1h, the resistance value of the developing roller is measured by applying a voltage of 100 V between the roller and the opposite electrode (metal drum) in the rotary resistance measuring device shown in FIG. 6.

In Examples H1-H10 and Comparative Example H1, the surface potential is measured after 0.35 second by using a device shown in FIG. 4 and applying a voltage of 8 kV to the roller to charge the roller surface through corona discharge and moving a measuring unit 14 at a speed of 200 mm/sec. Moreover, the form and size of the measuring unit are shown in FIG. 5. According to this method, the measurement is carried out over a full of the roller surface to determine a maximum value as a value of the surface potential. Moreover, the measuring environment is controlled to a temperature of 22° C. and a humidity of 50%.

As seen from each of the item-evaluation tables, the good evaluation results on the images are obtained on the sample of the developing roller in all examples.

TABLE 6

| Kind of material | | Name of material | Model number (name of maker) | Remarks |
|---|---|---|---|---|
| Base resin | | urethane acrylate oligomer | UF8001 (Kyoei-Sha Kagaku Co., Ltd.) | |
| Reactive diluent | D1 | methoxyethylene glycol acrylate | MTG-A (Kyoei-Sha Kagaku Co., Ltd.) | |
| | D2 | 2,2,2-trifluoroethyl acrylate | | fluorine-containing |
| | D3 | silocne modified at one terminal with acrylate | LS-2827 (Shin-Etsu Chemical Co., Ltd.) | silicon-containing |
| Polymerization initiator (long wavelength) | | acylphosphine oxide | IRGACURE819 (Chiba Specialty Chemicals Co., Ltd. | maximum wavelength: 430 nm |
| Polymerization initiator (short wavelength) | | α-hydroxyketone | IRGACURE184 (Chiba Specialty Chemicals Co., Ltd.) | maximum wavelength: 300 nm |
| Carbon-based electrically conducting agent | | carbon black | Denka Black (Denki Kagaku Kogyo Co., Ltd.) | |
| Ioninc electrically conducting agent | | sodium perchlorate | | |
| Electrically conducting agent of metal oxide | | ITO fine particles | | |
| Fine particles | | urethane fine particles | CFB101-40 (Dainippon Ink and Chemicals, Inc.) | |
| Solvent | | MEK | | |

TABLE 7

| | | | | Example 1a | Example 2a | Example 3a | Example 4a |
|---|---|---|---|---|---|---|---|
| Resin layer | Compounding recipe (part by weight) | Base resin | | 100 | 100 | 100 | 100 |
| | | Reactive diluent | D1 | 40 | 40 | 40 | 40 |
| | | | D2 | — | — | — | — |
| | | | D3 | — | — | — | — |
| | | Polymerization initiator (long wavelength) | | 5 | 2.5 | 5 | 2.5 |
| | | Polymerization initiator (short wavelength) | | — | 2.5 | — | 2.5 |
| | | Carbon-based electrically conducting agent | | 2.5 | 2.5 | 2.5 | 2.5 |
| | | Ioninc electrically conducting agent | | — | — | — | — |
| | | Electrically conducting agent of metal oxide | | — | — | — | — |
| | | Fine particles | | — | — | — | — |
| | | Solvent | | (*) | (*) | — | — |
| | | Layer thickness (μm) | | 150 | 280 | 20 | 50 |
| | Formation method | Film formation | | dipping | dipping | coater | coater |
| | | Film curing | | ultraviolet ray | ultraviolet ray | ultraviolet ray | ultraviolet ray |
| Elastic layer | | Presenceor absence-Kind | | none | none | none | none |
| Roller properties | | Resistance (Ω) | | $6 \times 10^6$ | $8 \times 10^7$ | $4 \times 10^4$ | $8 \times 10^4$ |
| | | Initial surface roughness Rz (μm) | | 2.0 | 1.8 | 7.8 | 6.2 |
| | Initial | Toner charging amount (μC/g) | | 35 | 40 | 29 | 28 |
| | | Toner transporting amount (mg/cm$^2$) | | 0.28 | 0.22 | 0.37 | 0.35 |
| | After 10000 papers | Toner charging amount (μC/g) | | 26 | 31 | 25 | 25 |
| | | Toner transporting amount (mg/cm$^2$) | | 0.31 | 0.27 | 0.38 | 0.36 |
| Evaluation of image | Initial | image concentration | | 4 | 4 | 4 | 4 |
| | | fogging | | 4 | 4 | 4 | 4 |
| | | concentration difference between leading and trailing ends | | 4 | 4 | 4 | 4 |
| | | image unevenness | | 4 | 4 | 4 | 4 |
| | | change of environment | | 4 | 4 | 4 | 4 |

TABLE 7-continued

| | | | | | | |
|---|---|---|---|---|---|---|
| | After 10000 papers | image concentration | 4 | 4 | 4 | 4 |
| | | fogging | 4 | 4 | 4 | 4 |
| | | concentration difference between leading and trailing ends | 4 | 4 | 4 | 4 |
| | | image unevenness | 4 | 4 | 4 | 4 |
| | | toner filmimg to roller | 4 | 4 | 4 | 4 |

| | | | Example 5a | Example 6a | Example 7a | Example 8a |
|---|---|---|---|---|---|---|
| Resin layer | Compounding recipe (part by weight) | Base resin | 100 | 100 | 100 | 100 |
| | | Reactive diluent D1 | 40 | 40 | — | — |
| | | D2 | — | — | 40 | — |
| | | D3 | — | — | — | 20 |
| | | Polymerization initiator (long wavelength) | 2.5 | 2.5 | 2.5 | 2.5 |
| | | Polymerization initiator (short wavelength) | 2.5 | 2.5 | 2.5 | 2.5 |
| | | Carbon-based electrically conducting agent | 2.5 | 2.5 | 2.5 | 2.5 |
| | | Ioninc electrically conducting agent | 20 | — | — | — |
| | | Electrically conducting agent of metal oxide | — | 50 | — | — |
| | | Fine particles | — | — | — | — |
| | | Solvent | (*) | (*) | — | — |
| | | Layer thickness (μm) | 280 | 170 | 50 | 50 |
| | Formation method | Film formation | dipping | dipping | coater | coater |
| | | Film curing | ultraviolet ray | ultraviolet ray | ultraviolet ray | ultraviolet ray |
| Elastic layer | | Presenceor absence-Kind | none | none | none | none |
| Roller properties | | Resistance (Ω) | $2 \times 10^7$ | $3 \times 10^6$ | $1 \times 10^5$ | $4 \times 10^5$ |
| | | Initial surface roughness Rz (μm) | 1.9 | 2.9 | 5.9 | 6.1 |
| | Initial | Toner charging amount (μC/g) | 33 | 32 | 21 | 22 |
| | | Toner transporting amount (mg/cm$^2$) | 0.24 | 0.3 | 0.34 | 0.35 |
| | After 10000 papers | Toner charging amount (μC/g) | 29 | 30 | 21 | 22 |
| | | Toner transporting amount (mg/cm$^2$) | 0.30 | 0.32 | 0.33 | 0.34 |
| Evaluation of image | Initial | image concentration | 4 | 4 | 4 | 4 |
| | | fogging | 4 | 4 | 4 | 4 |
| | | concentration difference between leading and trailing ends | 4 | 4 | 4 | 4 |
| | | image unevenness | 4 | 4 | 4 | 4 |
| | | change of environment | 5 | 5 | 4 | 4 |
| | After 10000 papers | image concentration | 4 | 4 | 4 | 4 |
| | | fogging | 4 | 4 | 4 | 4 |
| | | concentration difference between leading and trailing ends | 4 | 4 | 4 | 4 |
| | | image unevenness | 4 | 4 | 4 | 4 |
| | | toner filmimg to roller | 4 | 4 | 5 | 5 |

(*) ratio of solvent compounded: adjusted to 15% solution

TABLE 8

| | | | Example 9a | Example 10a | Example 11a | Example 12a |
|---|---|---|---|---|---|---|
| Resin layer | Compounding recipe (part by weight) | Base resin | 100 | 100 | 100 | 100 |
| | | D1 | 40 | 40 | 40 | 40 |
| | | D2 | — | — | — | — |
| | | D3 | — | — | — | — |
| | | Polymerization initiator (long wavelength) | 2.5 | 2.5 | 2.5 | 2.5 |
| | | Polymerization initiator (short wavelength) | 2.5 | 2.5 | 2.5 | 2.5 |
| | | Carbon-based electrically conducting agent | 2.5 | 2.5 | 2.5 | 2.5 |
| | | Ioninc electrically conducting agent | — | — | — | — |
| | | Electrically conducting agent of metal oxide | — | — | — | — |
| | | Fine particles | 20 | — | — | — |
| | | Solvent | — | — | — | (*) |
| | | Layer thickness (μm) | 10 | 50 | 50 | 500 |
| | Formation method | Film formation | coater | coater | coater | dipping |
| | | Film curing | ultraviolet ray | ultraviolet ray | ultraviolet ray | ultraviolet ray |
| Elastic layer | | Presenceor absence-Kind | none | urethane | silicone | none |
| Roller properties | | Resistance (Ω) | $2 \times 10^4$ | $5 \times 10^6$ | $7 \times 10^6$ | $3 \times 10^8$ |
| | | Initial surface roughness Rz (μm) | 8.0 | 4.5 | 3.3 | 0.6 |
| | Initial | Toner charging amount (μC/g) | 28 | 30 | 33 | 45 |
| | | Toner transporting amount (mg/cm$^2$) | 0.39 | 0.33 | 0.29 | 0.13 |
| | After 10000 papers | Toner charging amount (μC/g) | 25 | 28 | 31 | 9 |
| | | Toner transporting amount (mg/cm$^2$) | 0.38 | 0.34 | 0.30 | 0.14 |
| Evaluations of image | Initial | image concentration | 4 | 4 | 4 | 4 |
| | | fogging | 4 | 4 | 4 | 4 |
| | | concentration difference between leading and trailing ends | 4 | 4 | 4 | 4 |
| | | image unevenness | 4 | 4 | 4 | 4 |
| | | change of environment | 4 | 4 | 4 | 4 |
| | After 10000 papers | image concentration | 4 | 4 | 4 | 3 |
| | | fogging | 4 | 4 | 4 | 4 |

TABLE 8-continued

| | | | | | | |
|---|---|---|---|---|---|---|
| | | concentration difference between leading and trailing ends | 4 | 4 | 4 | 4 |
| | | image unevenness | 4 | 4 | 4 | 4 |
| | | toner filmimg to roller | 4 | 4 | 4 | 4 |

| | | | Example 13a | Comparative Example 1a | Comparative Example 2a | Comparative Example 3a |
|---|---|---|---|---|---|---|
| Resin layer | Compounding recipe (part by weight) | Base resin | 100 | No resin layer | 100 | 100 |
| | | D1 | 40 | | 40 | 40 |
| | | D2 | — | | — | — |
| | | D3 | — | | — | — |
| | | Polymerization initiator (long wavelength) | 2.5 | | 2.5 | 0 |
| | | Polymerization initiator (short wavelength) | 2.5 | | 2.5 | 2.5 |
| | | Carbon-based electrically conducting agent | 20 | | — | 2.0 |
| | | Ioninc electrically conducting agent | — | | — | — |
| | | Electrically conducting agent of metal oxide | — | | — | — |
| | | Fine particles | — | | — | — |
| | | Solvent | — | | — | — |
| | | Layer thickness (μm) | 50 | | 50 | 50 |
| | Formation method | Film formation | dipping | | coater | coater |
| | | Film curing | ultraviolet ray | | ultraviolet ray | ultraviolet ray |
| Elastic layer | | Presenceor absence-Kind | none | none | none | none |
| Roller properties | | Resistance (Ω) | $3 \times 10^7$ | metal conduction | $2 \times 10^9$ | not cured, evaluation impossible |
| | | Initial surface roughness Rz (μm) | 5.9 | 6 | 5.8 | |
| | Initial | Toner charging amount (μC/g) | 29 | 19 | 40 | |
| | | Toner transporting amount (mg/cm$^2$) | 0.36 | 0.3 | 0.31 | |
| | After 10000 papers | Toner charging amount (μC/g) | 25 | 10 | not evaluated | |
| | | Toner transporting amount (mg/cm$^2$) | 0.39 | 0.33 | | |
| Evaluations of image | Initial | image concentration | 4 | 3 | 1 | |
| | | fogging | 4 | 3 | 1 | |
| | | concentration difference between leading and trailing ends | 4 | 3 | 1 | |
| | | image unevenness | 4 | 2 | 1 | |
| | | change of environment | 4 | 3 | 1 | |
| | After 10000 papers | image concentration | 4 | 1 | not evaluated | |
| | | fogging | 3 | 1 | | |
| | | concentration difference between leading and trailing ends | 3 | 3 | 1 | |
| | | image unevenness | 3 | 1 | | |
| | | toner filmimg to roller | 3 | 1 | | |

(*) ratio of solvent compounded: adjusted to 15% solution

TABLE 9

| Kind of material | | Name of material | Model Number (name of maker) | Remarks |
|---|---|---|---|---|
| Base resin | | urethane acrylate oligomer | UV3200 (Nippon Gosei Kagaku Co., Ltd.) | |
| Reactive diluent | D1 | 1,9-nonanediol diacrylate | 1,9ND-A (Kyoei-Sha Kagaku Co., Ltd.) | |
| | D2 | 2,2,2-trifluoroethyl acrylate | | fluorine-containing |
| | D3 | silicone modified at one terminal with acrylate | LS-2827 (Shin-Etsu Chemical Co., Ltd.) | silicon-containing |
| Cabon-based electrically conducting agent | C1 | carbon black | Denka Black (Denki Kagaku Kogyo Co., Ltd. | |
| | C2 | carbon black | Printex35 (Degussa) | |
| Ioninc electrically conducting agent | | sodium perchlorate | | |
| Electrically conducting agent of metal oxide | | ITO fine particles | | |
| Fine particles | | urethane acrylate oligomer | CFB101-40 (Dainippon Ink and Chemicals, Inc.) | |
| Solvent | | MEK | | |

TABLE 10

| | | | | Example 1b | Example 2b | Example 3b | Example 4b | Example 5b | Example 6b | Example 7b |
|---|---|---|---|---|---|---|---|---|---|---|
| Resin layer | Compounding recipe (part by weight) | Base resin | | 100 | 100 | 100 | 100 | 100 | 100 | 100 |
| | | Reactive diluent | D1 | 40 | 40 | 40 | 40 | 40 | — | — |
| | | | D2 | — | — | — | — | — | 40 | — |
| | | | D3 | — | — | — | — | — | — | 20 |
| | | Carbon-based electrically conducting agent | C1 | 2.5 | 2.5 | — | 2.5 | 2.5 | 2.5 | 2.5 |
| | | | C2 | — | — | 30 | — | — | — | — |
| | | Ionic electrically conducting agent | | — | — | — | 20 | — | — | — |
| | | Electrically conducting agent of metal oxide | | — | — | — | — | 50 | — | — |

TABLE 10-continued

| | | | Example 1b | Example 2b | Example 3b | Example 4b | Example 5b | Example 6b | Example 7b |
|---|---|---|---|---|---|---|---|---|---|
| | | Fine particles | — | — | — | — | — | — | — |
| | | Solvent | (*) | — | (*) | (*) | (*) | — | — |
| | | Layer thickness (μm) | 170 | 35 | 200 | 270 | 180 | 50 | 50 |
| | Formation method | Film formation | dipping | coater | dipping | dipping | dipping | coater | coater |
| | | Film curing | electron beam | electron beam | electron beam | electron beam | electron beam | electron beam | electron beam |
| Elastic layer | Presenceor absence-Kind | | none | none | none | none | none | none | none |
| Roller properties | Resistance (Ω) | | $7 \times 10^6$ | $5 \times 10^4$ | $9 \times 10^5$ | $2 \times 10^7$ | $4 \times 10^6$ | $1 \times 10^5$ | $4 \times 10^5$ |
| | Initial surface roughness Rz (μm) | | 2.0 | 6.8 | 1.9 | 1.8 | 2.8 | 5.7 | 6 |
| | Initial | Toner charging amount (μC/g) | 38 | 31 | 39 | 34 | 33 | 22 | 21 |
| | | Toner transporting amount ($mg/cm^2$) | 0.26 | 0.32 | 0.24 | 0.24 | 0.32 | 0.34 | 0.34 |
| | After 10000 papers | Toner charging amount (μC/g) | 27 | 27 | 25 | 29 | 31 | 21 | 20 |
| | | Toner transporting amount ($mg/cm^2$) | 0.30 | 0.36 | 0.29 | 0.31 | 0.33 | 0.33 | 0.34 |
| Evaluations of image | Initial | image concentration | 4 | 4 | 4 | 4 | 4 | 4 | 4 |
| | | fogging | 4 | 4 | 4 | 4 | 4 | 4 | 4 |
| | | concentration difference between leading and trailing ends | 4 | 4 | 4 | 4 | 4 | 4 | 4 |
| | | image unevenness | 4 | 4 | 4 | 4 | 4 | 4 | 4 |
| | | change of environment | 4 | 4 | 4 | 5 | 5 | 4 | 4 |
| | After 10000 papers | image concentration | 4 | 4 | 4 | 4 | 4 | 4 | 4 |
| | | fogging | 4 | 4 | 4 | 4 | 4 | 4 | 4 |
| | | concentration difference between leading and trailing ends | 4 | 4 | 4 | 4 | 4 | 4 | 4 |
| | | image unevenness | 4 | 4 | 4 | 4 | 4 | 4 | 4 |
| | | toner filmimg to roller | 4 | 4 | 4 | 4 | 4 | 5 | 5 |

(*) ratio of solvent compounded: adjusted to 15% solution

TABLE 11

| | | | | Example 8b | Example 9b | Example 10b | Example 11b | Comparative Example 1b | Comparative Example 2b |
|---|---|---|---|---|---|---|---|---|---|
| Resin layer | Compounding recipe (part by weight) | Base resin | | 100 | 100 | 100 | 100 | no resin layer | 100 |
| | | Reactive diluent | D1 | 40 | 40 | 40 | 40 | | 40 |
| | | | D2 | — | — | — | — | | — |
| | | | D3 | — | — | — | — | | — |
| | | Carbon-based | C1 | 2.5 | 2.5 | 2.5 | — | | — |
| | | electrically | C2 | — | — | — | 30 | | — |
| | | Ionic electrically conducting agent | | — | — | — | — | | — |
| | | Electrically conducting agent of metal oxide | | — | — | — | — | | — |
| | | Fine particles | | 20 | — | — | — | | — |
| | | Solvent | | — | — | — | (*) | | — |
| | | Layer thickness (μm) | | 10 | 50 | 50 | 500 | | 50 |
| | Formation method | Film formation | | coater | coater | coater | dipping | | coater |
| | | Film curing | | electron beam | electron beam | electron beam | electron beam | | electron beam |
| Elastic layer | Presenceor absence-Kind | | | none | urethane | silicone | none | none | none |
| Roller properties | Resistance (Ω) | | | $2 \times 10^4$ | $5 \times 10^6$ | $6 \times 10^6$ | $8 \times 10^7$ | metal conduction | $2 \times 10^9$ |
| | Initial surface roughness Rz (μm) | | | 8.2 | 4.6 | 3.4 | 0.7 | 6 | 5.6 |
| | Initial | Toner charging amount (μC/g) | | 29 | 31 | 32 | 39 | 19 | 41 |
| | | Toner transporting amount ($mg/cm^2$) | | 0.39 | 0.32 | 0.29 | 0.17 | 0.3 | 0.32 |
| | After 10000 papers | Toner charging amount (μC/g) | | 26 | 28 | 30 | 9 | 10 | not evaluated |
| | | Toner transporting amount ($mg/cm^2$) | | 0.37 | 0.33 | 0.30 | 0.15 | 0.33 | |
| Evaluations of image | Initial | image concentration | | 4 | 4 | 4 | 3 | 4 | 1 |
| | | fogging | | 4 | 4 | 4 | 4 | 4 | 1 |
| | | concentration difference between leading and trailing ends | | 4 | 4 | 4 | 4 | 2 | 1 |
| | | image unevenness | | 4 | 4 | 4 | 4 | 2 | 1 |
| | | change of environment | | 4 | 4 | 4 | 4 | 4 | 1 |
| | After 10000 papers | image concentration | | 4 | 4 | 4 | 3 | 1 | not evaluated |
| | | fogging | | 4 | 4 | 4 | 3 | 1 | |
| | | concentration difference between | | 4 | 4 | 4 | 3 | 1 | |
| | | image unevenness | | 4 | 4 | 4 | 3 | 1 | |
| | | toner filmimg to roller | | 4 | 4 | 4 | 3 | 1 | |

(*) ratio of solvent compounded: adjusted to 15% solution

TABLE 12

| Kind of material | | Name of material | Model Number (name of maker) | Remarks |
|---|---|---|---|---|
| Base resin | RA1 | polyester urethane | UR8401 (Toyobo Co., Ltd.) | |
| | RA2 | nylon copolymer | CM8000 (Toray Industries, Inc.) | |
| | RA3 | modified urethane acrylate | RP116E (Shi-Nakamura Kagaku Kogyo Co., Ltd.) | |
| | RB1 | urethane acryloate oligomer | UF8001 (Kyoei-Sha Kagaku Co., Ltd.) | |
| | RB2 | | UV3200 (Nippon Gosei Kagaku Co., Ltd.) | |
| Crosslinking agent | B1 | isocyanate | HX (Nippon Polyurethane Co., Ltd.) | |
| | B2 | 2-hydroxyether acrylate | | |
| Reactive diluent | D1 | methoxytriethylene glycol acrylate | MTG-A (Kyoei0Sha Kagaku Co., Ltd.) | |
| | D2 | 1,9-nonadiol diacrylate | 1,9ND-A (Kyoei Kagaku Co., Ltd.) | |
| | D3 | 2,2,2-trifluoroethyl acrylate | | fluorine-containing |
| | D4 | silicone modified at one terminal with acrylate | LS-2827 (Shin-Etsu Chemical Co., Ltd.) | silicon-containing |
| Polymerization initiator (long wavelength) | | acylphosphine oxide | IRGACURE819 (Chiba Specialty Chemicals Co., Ltd.) | maximum wavelength: 430 nm |
| Polymerization initiator (short wavelength) | | α-hydroxyketone | IRGACURE184 (Chiba Specialty Chemicals Co., Ltd.) | maximum wavelength: 300 nm |
| Carbon-based electrically conducting agent | C1 | carbon black | | |
| | C2 | carbon black | Printex35 (Degussa) | |
| Solvent | S1 | MEK | | |
| | S2 | ethanol | | |
| | S3 | water | | |

TABLE 13

| | | | | Example 1c | Example 2c | Example 3c | Example 4c | Example 5c | Example 6c |
|---|---|---|---|---|---|---|---|---|---|
| First resin layer | Compounding recipe (part by weight | Base resin | RA1 | 100 | 100 | — | — | — | 100 |
| | | | RA2 | — | — | 100 | — | — | — |
| | | | RA3 | — | — | — | — | 100 | — |
| | | | RB2 | — | — | — | 100 | — | — |
| | | Crosslinking agent | B1 | 10 | 10 | — | — | — | 10 |
| | | | B2 | — | — | — | — | 40 | — |
| | | Reactive diluent | D2 | — | — | — | 40 | — | — |
| | | Polymerization initiator (long wavelength) | | — | — | — | — | 2.5 | — |
| | | Polymerization initiator (short wavelength) | | — | — | — | — | 2.5 | — |
| | | Carbon-based electrically conducting agent | C1 | 25 | 25 | 25 | — | — | 25 |
| | | | C2 | — | — | — | 2.5 | 2.5 | — |
| | | Solvent | S1 | (*) | (*) | — | — | — | (*) |
| | | | S2 | — | — | (*) | — | — | — |
| | | | S3 | — | — | — | — | (*) | — |
| | | Layer thickness (μm) | | 30 | 30 | 30 | 10 | 10 | 30 |
| | Formation method | Film formation | | dipping | dipping | dipping | coater | dipping | dipping |
| | | Film curing | | heating | heating | air drying | electron beam | ultraviolet ray | heating |
| | | Volume resistivity (Ω/cm$^3$) | | $2 \times 10^4$ | $2 \times 10^4$ | $7 \times 10^5$ | $5 \times 10^3$ | $8 \times 10^3$ | $2 \times 10^4$ |
| Second resin layer | Compounding recipe (part by weight) | Base resin | RB1 | 100 | — | 100 | 100 | 100 | 100 |
| | | | RB2 | — | 100 | — | — | — | — |
| | | Reactive diluent | D1 | 40 | — | 40 | 40 | 40 | — |
| | | | D2 | — | 40 | — | — | — | — |
| | | | D3 | — | — | — | — | — | 40 |
| | | | D4 | — | — | — | — | — | — |
| | | Polymerization initiator (long wavelength) | | 5 | — | 2.5 | 2.5 | 2.5 | 2.5 |
| | | Polymerization initiator (short wavelength) | | 2.5 | — | 2.5 | 2.5 | 2.5 | 2.5 |
| | | Carbon-based electrically conduction agent | C2 | — | — | — | — | — | — |
| | | Solvent | S1 | — | — | (*) | — | (*) | — |
| | | Layer thickness (μm) | | 10 | 10 | 15 | 10 | 10 | 10 |
| | Formation method | Film formation | | coater | coater | dipping | coater | dipping | coater |
| | | Film curing | | ultraviolet ray | electron beam | ultraviolet ray | ultraviolet ray | ultraviolet ray | ultraviolet ray |
| | | Volume resistivity (Ω/cm$^3$) | | $>10^{10}$ | $>10^{10}$ | $>10^{10}$ | $>10^{10}$ | $>10^{10}$ | $>10^{10}$ |
| | | Second resin extraction amount (%) | | 2 | 1 | 2 | 2 | 2 | 3 |
| Elastic layer | | Presence or absence-Kind | | none | none | none | none | none | none |
| Roller properties | | Resistance (Ω) | | $6 \times 10^3$ | $7 \times 10^5$ | $4 \times 10^7$ | $3 \times 10^4$ | $8 \times 10^4$ | $9 \times 10^3$ |
| | | Initial surface roughness Rz (μm) | | 4.2 | 4.3 | 2.9 | 5.2 | 5.5 | 4.1 |
| | Initial | Toner charging amount (μC/g) | | 34 | 31 | 30 | 29 | 28 | 27 |
| | | Toner transporting amount (mg/cm$^2$) | | 0.3 | 0.31 | 0.28 | 0.36 | 0.35 | 0.29 |
| | After 10000 papers | Toner charging amount (μC/g) | | 31 | 30 | 29 | 28 | 26 | 27 |
| | | Toner transporting amount (mg/cm$^2$) | | 0.31 | 0.32 | 0.29 | 0.36 | 0.37 | 0.28 |
| Evaluations of image | Initial | image concentration | | 4 | 4 | 4 | 4 | 4 | 4 |
| | | fogging | | 4 | 4 | 4 | 4 | 4 | 4 |
| | | concentration difference between leading and trailing ends | | 4 | 4 | 4 | 4 | 4 | 4 |

TABLE 13-continued

| | | Example 1c | Example 2c | Example 3c | Example 4c | Example 5c | Example 6c |
|---|---|---|---|---|---|---|---|
| | image unevenness | 4 | 4 | 4 | 4 | 4 | 4 |
| | change of environment | 4 | 4 | 4 | 4 | 4 | 4 |
| | contamination of photosensitive body | 4 | 4 | 4 | 4 | 4 | 4 |
| After 10000 papers | image concentration | 4 | 4 | 4 | 4 | 4 | 4 |
| | fogging | 4 | 4 | 4 | 4 | 4 | 4 |
| | concentration difference between leading and trailing ends | 4 | 4 | 4 | 4 | 4 | 4 |
| | image unevenness | 4 | 4 | 4 | 4 | 4 | 4 |
| | toner filming to roller | 4 | 4 | 4 | 4 | 4 | 5 |

(*) ratio of solvent compounded: adjusted to 15% solution

TABLE 14

| | | | | Example 7c | Example 8c | Example 9c | Comparative Example 1c | Comparative Example 2c | Comparative Example 3c |
|---|---|---|---|---|---|---|---|---|---|
| First resin layer | Compounding recipe (part by weight) | Base resin | RA1 | 100 | 100 | 100 | none | 100 | 100 |
| | | | RA2 | — | — | — | | — | — |
| | | | RA3 | — | — | — | | — | — |
| | | | RB2 | — | — | — | | — | — |
| | | Crosslinking agent | B1 | 10 | 10 | 10 | | 10 | 10 |
| | | | B2 | — | — | — | | — | — |
| | | Reactive diluent | D2 | — | — | — | | — | — |
| | | Polymerization initiator (long wavelength) | | — | — | — | | — | — |
| | | Polymerization initiator (short wavelength) | | — | — | — | | — | — |
| | | Carbon-based electrically conducting agent | C1 | 25 | 25 | 25 | | 25 | — |
| | | | C2 | — | — | — | | — | — |
| | | Solvent | S1 | (*) | (*) | (*) | | (*) | (*) |
| | | | S2 | — | — | — | | — | — |
| | | | S3 | — | — | — | | — | — |
| | | Layer thickness (μm) | | 30 | 30 | 30 | | 30 | 30 |
| | Formation method | Film formation | | dipping | dipping | dipping | | dipping | dipping |
| | | Film curing | | heating | heating | heating | | heating | heating |
| | | Volume resistivity (Ω/cm$^3$) | | $2 \times 10^4$ | $2 \times 10^4$ | $2 \times 10^4$ | | $2 \times 10^4$ | $>10^{10}$ |
| Second resin layer | Compounding recipe (part by weight) | Base resin | RB1 | 100 | 100 | 100 | none | none | none |
| | | | RB2 | — | — | — | | | |
| | | Reactive diluent | D1 | 40 | 40 | 40 | | | |
| | | | D2 | — | — | — | | | |
| | | | D3 | — | — | — | | | |
| | | | D4 | 20 | — | — | | | |
| | | Polymerization initiator (long wavelength) | | 2.5 | 2.5 | 2.5 | | | |
| | | Polymerization initiator (short wavelength) | | 2.5 | 2.5 | 2.5 | | | |
| | | Carbon-based electrically conducting agent | C2 | — | — | — | | | |
| | | Solvent | S1 | — | — | — | | | |
| | | Layer thickness (μm) | | 10 | 10 | 10 | | | |
| | Formation method | Film formation | | coater | coater | coater | | | |
| | | Film curing | | ultraviolet ray | ultraviolet ray | ultraviolet ray | | | |
| | | Volume resistivity (Ω/cm$^3$) | | $>10^{10}$ | $>10^{10}$ | $>10^{10}$ | | | |
| | | Second resin extraction amount (%) | | 3 | 3 | 3 | | | |
| Elastic layer | | Presence or absence-Kind | | none | urethane | silicon | none | none | none |
| Roller properties | | Resistance (Ω) | | $9 \times 10^5$ | $5 \times 10^6$ | $7 \times 10^6$ | metal conduction | $2 \times 10^5$ | $3 \times 10^9$ |
| | | Initial surface roughness Rz (μm) | | 4.2 | 5.5 | 5.8 | 6 | 4.7 | 4.7 |
| | Initial | Toner charging amount (μC/g) | | 29 | 26 | 25 | 19 | 27 | 40 |
| | | Toner transporting amount (mg/cm$^2$) | | 0.3 | 0.33 | 0.35 | 0.3 | 0.33 | 0.33 |
| | After 10000 papers | Toner charging amount (μC/g) | | 28 | 26 | 25 | 10 | 12 | not evaluated |
| | | Toner transporting amount (mg/cm$^2$) | | 0.30 | 0.34 | 0.34 | 0.33 | 0.38 | |
| Evaluations of image | Initial | image concentration | | 4 | 4 | 4 | 4 | 3 | 1 |
| | | fogging | | 4 | 4 | 4 | 3 | 3 | 2 |
| | | concentration difference between leading and trailing ends | | 4 | 4 | 4 | 2 | 3 | 2 |

TABLE 14-continued

| | | Example 7c | Example 8c | Example 9c | Comparative Example 1c | Comparative Example 2c | Comparative Example 3c |
|---|---|---|---|---|---|---|---|
| | image unevenness | 4 | 4 | 4 | 2 | 3 | 2 |
| | change of environment | 4 | 4 | 4 | 4 | 3 | 2 |
| | contamination of photosensitive body | 4 | 4 | 4 | 4 | 3 | 3 |
| After 10000 papers | image concentration | 4 | 4 | 4 | 1 | 1 | not evaluated |
| | fogging | 4 | 4 | 4 | 1 | 1 | |
| | concentration difference between leading and trailing ends | 4 | 4 | 4 | 1 | 1 | |
| | image unevenness | 4 | 4 | 4 | 1 | 1 | |
| | toner filming to roller | 5 | 4 | 4 | 1 | 1 | |

(*) ratio of solvent compounded: adjusted to 15% solution

TABLE 15

| Kind of material | | Name of material | Model Number (name of maker) | Remarks |
|---|---|---|---|---|
| Base resin | RA1 | polyester urethane | UR8401 (Toyobo Co., Ltd.) | |
| | RA2 | nylon copolymer | CM8000 (Toray Industries, Inc.) | |
| | RB1 | urethane acrylate oligomer | UF8001 (Kyoei-Sha Kagaku Co.. Ltd.) | |
| | RB2 | urethane acrylate oligomer | UV3200 (Nippon Gosei Kagaku Co., Ltd.) | |
| Crosslinking agent | | isocyanate | HX (Nippon Polyurethane Co., Ltd.) | |
| Reactive diluent | D1 | methoxytriethylene glycol acrylate | MTG-A (Kyoei-Sha Kagaku Co., Ltd.) | |
| | D2 | 1,9-nonanediol diacrylate | 1,9ND-A (Kyoei Kagaku Co., Ltd.) | |
| | D3 | 2,2,2-trifluoroethyl acrylate | | fluorine-containing |
| | D4 | silicone modified at one terminal with acrylate | LS-2827 (Shin-Etsu Chemical Co., Ltd.) | silicone-containing |
| Polymerization initiator (long wavelength) | | acylphosphine oxide | IRGACURE819 (Chiba Specialty Chemicals Co., Ltd.) | maximum wavelength: 430 nm |
| Polymerization initiator (short wavelength) | | α-hydroxyketone | IRGACURE184 (Chiba Specialty Chemicals Co., Ltd.) | maximum wavelength: 300 nm |
| Carbon-based electrically conducting agent | | carbon black | Printex35 (Degussa) | |
| Fine particles | F1 | urethane acrylate oligomer | CFB101-40 (Dainippon Ink and Chemicals Co., Ltd.) | |
| | F2 | phenol | Belpearl R (Kanebo, Ltd. | |
| | F3 | styrene | Chemisnow SGP (Soken Kagaku Co., Ltd. | |
| | F4 | acryl | Chemisnow MR (Soken Kagaku Co., Ltd.) | |
| | F5 | flourine | Tospearl (Toshiba Silicon Co., Ltd.) | |
| | F6 | silicone modified at one terminal with acrylate | | |
| Solvent | S1 | MEK | | |
| | S2 | ethanol | | |

TABLE 16

| | | | | Example 1d | Example 2d | Example 3d | Example 4d | Example 5d | Example 6d |
|---|---|---|---|---|---|---|---|---|---|
| First resin layer | Compounding recipe (part by weight) | Base resin | RA1 | 100 | 100 | 100 | — | 100 | 100 |
| | | | RA2 | — | — | — | 100 | — | — |
| | | Crosslinking agent | | 10 | 10 | 10 | — | 10 | 10 |
| | | Carbon-based electrically conducting agent | | — | 25 | 25 | 20 | 25 | 25 |
| | | Fine particles | F1 | 10 | — | — | — | — | — |
| | | | F2 | — | 10 | — | — | — | — |
| | | | F3 | — | — | 10 | — | — | — |
| | | | F4 | — | — | — | 10 | — | — |
| | | | F5 | — | — | — | — | 10 | — |
| | | | F6 | — | — | — | — | — | 10 |
| | | Solvent | S1 | (*) | (*) | (*) | — | (*) | (*) |
| | | | S2 | — | — | — | (*) | — | — |
| | | Layer thickness (μm): b1 | | 8 | 10 | 8 | 20 | 4 | 10 |
| | | Particle size of fine particles (μm): a | | 9 | 18 | 30 | 50 | 7 | 25 |
| | Formation method | Film formation | | dipping | dipping | dipping | dipping | dipping | dipping |
| | | Film curing | | heating | heating | heating | heating | heating | heating |
| | | Volume resistivity ($\Omega/cm^3$) | | $>10^{10}$ | $3 \times 10^4$ | $3 \times 10^4$ | $6 \times 10^5$ | $9 \times 10^4$ | $3 \times 10^4$ |
| Second resin layer | Compounding recipe (part by weight) | Base resin | RA1 | none | 100 | — | — | — | — |
| | | | RB1 | | — | 100 | — | 100 | 100 |
| | | | RB2 | | — | — | 100 | — | — |
| | | Crosslinking agent | | | 10 | — | — | — | — |
| | | Reactive diluent | D1 | | — | 40 | — | — | — |
| | | | D2 | | — | — | 40 | — | — |
| | | | D3 | | — | — | — | 40 | — |
| | | | D4 | | — | — | — | — | 20 |

TABLE 16-continued

| | | | Example 1d | Example 2d | Example 3d | Example 4d | Example 5d | Example 6d |
|---|---|---|---|---|---|---|---|---|
| | | Polymerization initiator (long wavelength) | | — | 2.5 | — | 2.5 | 2.5 |
| | | Polymerization initiator (short wavelength) | | — | 2.5 | — | 2.5 | 2.5 |
| | | Carbon-based electrically conducting agent | | — | — | — | — | — |
| | | Solvent S1 | | (*) | (*) | (*) | (*) | (*) |
| | | Layer thickness (μm) | | 5 | 5 | 10 | 2 | 2 |
| | Formation method | Film formation | | dipping | dipping | dipping | dipping | dipping |
| | | Film curing | | heating | ultraviolet ray | electron beam | ultraviolet ray | ultraviolet ray |
| | | Volume resistivity (Ω/cm$^3$) | | >$10^{10}$ | >$10^{10}$ | >$10^{10}$ | >$10^{10}$ | >$10^{10}$ |
| Elastic layer | | Presence or absence-Kind | none | none | none | none | none | none |
| Roller properties | | Resistance (Ω) | $4 \times 10^6$ | $6 \times 10^5$ | $8 \times 10^6$ | $7 \times 10^7$ | $1 \times 10^5$ | $2 \times 10^5$ |
| | | Initial surface roughness Rz (μm) | 3.5 | 3.2 | 7.5 | 6.9 | 3.5 | 5.2 |
| | | Particle size/total thickness of resin layer (a/(b1 + b2)) | 1.1 | 1.2 | 2.3 | 1.7 | 1.2 | 2.1 |
| | Initial | Toner charging amount (μC/g) | 31 | 34 | 29 | 29 | 32 | 28 |
| | | Toner transporting amount (mg/cm$^2$) | 0.33 | 0.3 | 0.38 | 0.35 | 0.31 | 0.33 |
| | After 10000 papers | Toner charging amount (μC/g) | 28 | 32 | 28 | 27 | 30 | 26 |
| | | Toner transporting amount (mg/cm$^2$) | 0.30 | 0.28 | 0.30 | 0.31 | 0.30 | 0.30 |
| Evaluations of image | Initial | image concentration | 4 | 4 | 4 | 4 | 4 | 4 |
| | | fogging | 4 | 4 | 4 | 4 | 4 | 4 |
| | | concentration difference between leading and trailing ends | 4 | 4 | 4 | 4 | 4 | 4 |
| | | image unevenness | 4 | 4 | 4 | 4 | 4 | 4 |
| | | change of environment | 4 | 4 | 4 | 4 | 4 | 4 |
| | After 10000 papers | image concentration | 4 | 4 | 4 | 4 | 4 | 4 |
| | | fogging | 4 | 4 | 4 | 4 | 4 | 4 |
| | | concentration difference between leading and trailing ends | 3 | 4 | 4 | 4 | 4 | 4 |
| | | image unevenness | 4 | 4 | 4 | 4 | 4 | 4 |
| | | toner filmimg to roller | 4 | 4 | 4 | 4 | 5 | 5 |

(*) ratio of solvent compounded: adjusted to 15% solution

TABLE 17

| | | | | Example 7d | Example 8d | Example 9d | Example 10d | Comparative Example 1d |
|---|---|---|---|---|---|---|---|---|
| First resin layer | Compounding recipe (part by weight) | Base resign | RA1 | 100 | 100 | 100 | 100 | none |
| | | | RA2 | — | — | — | — | |
| | | Crosslinking agent | | 10 | 10 | 10 | 10 | |
| | | Carbon-based electrically conducting agent | | 25 | 25 | 25 | 25 | |
| | | Fine particles | F1 | 10 | 10 | — | 10 | |
| | | | F2 | — | — | 10 | — | |
| | | | F3 | — | — | — | — | |
| | | | F4 | — | — | — | — | |
| | | | F5 | — | — | — | — | |
| | | | F6 | — | — | — | — | |
| | | Solvent | S1 | (*) | (*) | (*) | (*) | |
| | | | S2 | — | — | — | — | |
| | | Layer thickness (μm): b1 | | 5 | 5 | 10 | 10 | |
| | | Particle size of fine particles (μm): a | | 9 | 9 | 30 | 9 | |
| | Formation method | Film Formation | | dipping | dipping | dipping | dipping | |
| | | Film curing | | heating | heating | heating | heating | |
| | | Volume resistivity (Ω/cm$^3$) | | $3 \times 10^4$ | $3 \times 10^4$ | $3 \times 10^4$ | $3 \times 10^4$ | |
| Second resin layer | Compounding recipe (part by weight) | Base resin | RA1 | — | — | 100 | — | none |
| | | | RB1 | 100 | 100 | — | 100 | |
| | | | RB2 | — | — | — | — | |
| | | Crosslinking agent | | — | — | 10 | — | |
| | | Reactive diluent | D1 | 40 | 40 | — | 40 | |
| | | | D2 | — | — | — | — | |
| | | | D3 | — | — | — | — | |
| | | | D4 | — | — | — | — | |
| | | Polymerization initiator (long wavelength) | | 2.5 | 2.5 | — | 2.5 | |
| | | Polymerization initiator (short wavelength) | | 2.5 | 2.5 | — | 2.5 | |
| | | Carbon-based electrically conducting agent | | — | — | 25 | — | |
| | | Solvent | S1 | (*) | (*) | (*) | (*) | |
| | | Layer thickness (μm) | | 3 | 3 | 10 | 5 | |
| | Formation method | Film Formation | | dipping | dipping | dipping | dipping | |
| | | Film curing | | ultraviolet ray | ultraviolet ray | heating | ultraviolet ray | |
| | | Volume resistivity (Ω/cm$^3$) | | >$10^{10}$ | >$10^{10}$ | $3 \times 10^4$ | >$10^{10}$ | |
| Elastic layer | | Presence or absence-Kind | | urethane | silicon | none | none | none |
| Roller properties | | Resistance (Ω) | | $5 \times 10^6$ | $6 \times 10^6$ | $7 \times 10^4$ | $2 \times 10^5$ | metal conduction |
| | | Initial surface roughness Rz (μm) | | 4.4 | 4.6 | 5.9 | 4.9 | 6 |

TABLE 17-continued

| | | | Example 7d | Example 8d | Example 9d | Example 10d | Comparative Example 1d |
|---|---|---|---|---|---|---|---|
| | Particle size/total thickness of resin layers (a/(b1 + b2)) | | 1.1 | 1.1 | 1.5 | 0.9 | — |
| | Initial | Toner charging amount (μC/g) | 30 | 32 | 28 | 30 | 19 |
| | | Toner transporting amount (mg/cm$^2$) | 0.32 | 0.31 | 0.37 | 0.33 | 0.3 |
| | After 10000 papers | Toner charging amount (μC/g) | 30 | 32 | 20 | 9 | 10 |
| | | Tones transporting amount (mg/cm$^2$) | 0.32 | 0.30 | 0.35 | 0.15 | 0.33 |
| Evaluations of image | Initial | image concentration | 4 | 4 | 4 | 3 | 4 |
| | | fogging | 4 | 4 | 4 | 4 | 4 |
| | | concentration difference between leading and trailing ends | 4 | 4 | 4 | 3 | 2 |
| | | image unevenness | 4 | 4 | 4 | 3 | 2 |
| | | change of environments | 4 | 4 | 4 | 4 | 4 |
| | After 10000 papers | image concentration | 4 | 4 | 4 | 3 | 1 |
| | | fogging | 4 | 4 | 3 | 3 | 1 |
| | | concentration difference between leading and trailing ends | 4 | 4 | 3 | 3 | 1 |
| | | image unevenness | 4 | 4 | 3 | 3 | 1 |
| | | toner filming of roller | 4 | 4 | 4 | 3 | 1 |

(*) ratio of solvent compounded: adjusted to 15% solution

TABLE 18

| Kind of material | | Name of material | Model Number (name of maker) | Remarks |
|---|---|---|---|---|
| Base resin | RA | nylon copolymer | CM8000 (Toray Industries, Inc.) | |
| | RB1 | urethane acrylate oligomer | UV2750B (Nippon Gosei Kagaku Co., Ltd.) | |
| | RB2 | | UA-NDP (Shi-Nakamura Kagaku Co., Ltd.) | |
| | RB3 | | UF8001 (Kyoei-Sha Kagaku Co., Ltd.) | |
| | RB4 | | UV3200B (Nippon Gosei Kagalu Co., Ltd.) | |
| | RB5 | | UV2000 (Nippon Gosei Kagaku Co., Ltd.) | |
| Crosslinking agent | | isocyanate | HX (Nippon Polyurethane Co., Ltd.) | |
| Reactive diluent | | methoxytriethylene glycol acrylate | MTG-A (Kyoci-Sha Kagaku Co., Ltd.) | |
| Polymerization initiator (long wavelength) | | acylphosphine oxide | IRGACURE819 (Chiba Specialty Chemicals Co., Ltd.) | maximum wavelength: 430 nm |
| Polymerization initiator (short wavelength) | | α-hydroxyketone | IRGACURE184 (Chiba Specialty Chemicals Co., Ltd.) | maximum wavelength: 300 nm |
| Carbon-based electrically conducting agent | C1 | carbon blank | Printex35 (Degussa) | |
| | C2 | carbon black | Denka Black (Denki Kagaku Kogyo Co., Ltd. | |
| Ionic electrically conducting agent | | sodium perchlorate | | |
| Solvent | S1 | ethanol | | |
| | S2 | MEK | | |

TABLE 19

| | | | | Example 1e | Example 2e | Example 3e | Example 4e | Example 5e |
|---|---|---|---|---|---|---|---|---|
| First resin layer | Compounding recipe (part by weight) | Base resin | RA | none | none | none | none | 100 |
| | | Crosslinking agent | | | | | | 0 |
| | | Carbon-based electrically conducting agent | C1 | | | | | 20 |
| | | Solvent | S1 | | | | | (*) |
| | | Layer thickness (μm) | | | | | | 50 |
| | Formation method | Film Formation | | | | | | dipping |
| | | Film curing | | | | | | heating |
| Second resisn layer | Compounding recipe (part by weight) | Base resin | RB1 | 100 | — | 100 | — | — |
| | | | RB2 | — | 100 | — | 100 | — |
| | | | RB3 | — | — | — | — | 100 |
| | | | RB4 | — | — | — | — | — |
| | | | RB5 | — | — | — | — | — |
| | | Reactive diluent | | 40 | 40 | 40 | 40 | 40 |
| | | Polymerization initiator (long wavelength) | | 5 | — | 5 | — | 5 |
| | | Polymerization initiator (short wavelength) | | 2.5 | — | 2.5 | — | 2.5 |
| | | Carbon-based electrically conducting agent | C2 | — | 2.5 | — | 2.5 | — |
| | | Ioninc electrically conducting agent | | 5 | — | 5 | — | — |
| | | Solvent | S2 | (*) | (*) | — | — | (*) |
| | | Layer thickness (μm) | | 50 | 70 | 15 | 20 | 10 |

TABLE 19-continued

| | | | Example 1e | Example 2e | Example 3e | Example 4e | Example 5e |
|---|---|---|---|---|---|---|---|
| | Formation method | Film Formation | dipping | dipping | coater | coater | dipping |
| | | Film curing | ultraviolet ray | electron beam | ultraviolet ray | electron beam | ultraviolet ray |
| Elastic layer | | Presence or absence-Kind | none | none | none | none | none |
| Roller properties | | Resistance (Ω) | $7 \times 10^6$ | $3 \times 10^4$ | $1 \times 10^6$ | $1 \times 10^4$ | $4 \times 10^7$ |
| | | Initial surface roughness Rz (μm) | 2.2 | 1.9 | 2.8 | 2.9 | 1.8 |
| | | Creep value (μm) | 5.1 | 6.8 | 1.2 | 2 | 3.2 |
| | Initial | Toner charging amount (μC/g) | 33 | 29 | 35 | 31 | 39 |
| | | Toner transporting amount (mg/cm$^2$) | 0.25 | 0.23 | 0.28 | 0.3 | 0.22 |
| | After 10000 papers | Toner charging amount (μC/g) | 29 | 26 | 32 | 27 | 38 |
| | | Toner transporting amount (mg/cm$^2$) | 0.28 | 0.24 | 0.30 | 0.33 | 0.24 |
| Evaluations of image | Initial | image concentration | 4 | 4 | 4 | 4 | 4 |
| | | fogging | 4 | 4 | 4 | 4 | 4 |
| | | concentration difference between leading and trailing ends | 4 | 4 | 4 | 4 | 4 |
| | | image unevenness | 4 | 4 | 4 | 4 | 4 |
| | | change of environments | 4 | 4 | 4 | 4 | 4 |
| | After 10000 papers | image concentration | 4 | 4 | 4 | 4 | 4 |
| | | fogging | 4 | 4 | 4 | 4 | 4 |
| | | concentration difference between leading and trailing ends | 4 | 4 | 4 | 4 | 4 |
| | | image unevenness | 4 | 4 | 4 | 4 | 4 |
| | | Presence or absence of blade trace | 4 | 4 | 5 | 5 | 5 |
| | | Toner filming of roller | 4 | 4 | 4 | 4 | 5 |

(*) ratio of solvent compounded: adjusted to 15% solution

TABLE 20

| | | | | Example 6e | Example 7e | Example 8e | Comparative Example 1e |
|---|---|---|---|---|---|---|---|
| First resin layer | Compounding recipe (part by weight) | Base resin | RA | none | none | none | none |
| | | Crosslinking agent | | | | | |
| | | Carbon-based electrically | C1 | | | | |
| | | Solvent | S1 | | | | |
| | | Layer thickness (μm) | | | | | |
| | Formation method | Film formation | | | | | |
| | | Film curing | | | | | |
| Second resisn layer | Compounding recipe (part by weight) | Base resin | RB1 | — | — | — | none |
| | | | RB2 | — | — | — | |
| | | | RB3 | 100 | 100 | — | |
| | | | RB4 | — | — | 100 | |
| | | | RB5 | — | — | — | |
| | | Reactive diluent | | 40 | 40 | 40 | |
| | | Polymerization initiator (long wavelength) | | 5 | 5 | — | |
| | | Polymerization initiator (short wavelength) | | 2.5 | 2.5 | — | |
| | | Carbon-based electrically | C2 | — | — | 2.5 | |
| | | Ioninc electrically conducting agent | | — | — | — | |
| | | Solvent | S2 | — | — | (*) | |
| | | Layer thickness (μm) | | 10 | 10 | 500 | |
| | Formation method | Film formation | | coater | coater | dipping | |
| | | Film curing | | ultraviolet ray | ultraviolet ray | electron beam | |
| Elastic layer | Presence or absence-kind | | | urethane | silicon | none | none |
| Roller properties | Resistance (Ω) | | | $6 \times 10^6$ | $8 \times 10^6$ | $3 \times 10^8$ | metal conduction |
| | Initial surface roughness Rz (μm) | | | 4.2 | 3.5 | 0.6 | 6 |
| | Creep value (μm) | | | 0.8 | 0.9 | 9.2 | — |
| | Initial | Toner charging amount (μC/g) | | 35 | 36 | 32 | 19 |
| | | Toner transporting amount (mg/cm$^2$) | | 0.37 | 0.34 | 0.12 | 0.3 |
| | After 10000 papers | Toner charging amount (μC/g) | | 35 | 36 | 22 | 10 |
| | | Toner transporting amount (mg/cm$^2$) | | 0.37 | 0.34 | 0.13 | 0.33 |
| Evaluations of image | Initial | image concentration | | 4 | 4 | 3 | 4 |
| | | fogging | | 4 | 4 | 4 | 4 |
| | | concentration difference between leading and trailing ends | | 4 | 4 | 4 | 2 |
| | | image unevenness | | 4 | 4 | 4 | 2 |
| | | change of environment | | 4 | 4 | 4 | 4 |
| | After 10000 papers | image concentration | | 4 | 4 | 3 | 1 |
| | | fogging | | 4 | 4 | 4 | 1 |
| | | concentration difference between leading and trailing ends | | 4 | 4 | 3 | 1 |
| | | image unevenness | | 4 | 4 | 4 | 1 |
| | | Presence or absence of blade trace | | 5 | 5 | 3 | 4 |
| | | Toner filming to roller | | 5 | 5 | 3 | 1 |

(*) ratio of solvent compounded: adjusted to 15% solution

TABLE 21

| Kind of material | | Name of material | Model Number (name of maker) | Remarks |
|---|---|---|---|---|
| Base resin | RA | nylon copolymer | CM8000 (Toray Industries, Inc.) | |
| | RB1 | polyester urethane | UR8401 (Toyobo Co., Ltd.) | |
| | RB2 | urethane acrylate oligomer | UV3200 (Nippon Gosci Kagaku Co., Ltd.) | |
| | RB3 | | UA-NDP (Shin-Nakamura Kagaku Co., Ltd.) | |
| | RB4 | | UF8001 (Kyoci-Sha Kagaku Co., Ltd.) | |
| Crosslinking agent | | isocyanate | HX (Nippon Polyurethane Co. Ltd.) | |
| Reactive diluent | | methoxytriethylene glycol acrylate | MTG-A (Kyoei-Sha Kagaku Co., Ltd.) | |
| Polymerization initiator (long wavelength) | | acylphosphine oxide | IRGACURE819 (Chiba Specialty Chemicals Co., Ltd.) | maximum wavelength: 430 nm |
| Polymerization initiator (short wavelength) | | α-hydroxyketone | IRGACURE184 (Chiba Specialty Chemicals Co., Ltd.) | maximum wavelength: 300 nm |
| Carbon-based electrically conducting agent | C1 | carbon black | Printex35 (Degussa) | |
| | C2 | | Denka Black (Denki Kagaku Kogyo Co., Ltd.) | |
| | C3 | | Ketjenblack EC | |
| Ionic electrically conducting agent | | sodium perchlorate | | |
| Solvent | S1 | ethanol | | |
| | S2 | MEK | | |

TABLE 22

| | | | | Example 1f | Example 2f | Example 3f | Example 4f | Example 5f |
|---|---|---|---|---|---|---|---|---|
| First resin layer | Compounding recipe (part by weight) | Base resin | RA | none | none | none | none | none |
| | | Carbon-based electrically conducting agent | C1 | | | | | |
| | | Solvent | S1 | | | | | |
| | | Layer thickness (μm) | | | | | | |
| | Formation method | Film formation | | | | | | |
| | | Film curing | | | | | | |
| Second resin layer | Compounding recipe (part by weight) | Base resin | RB1 | 100 | — | — | — | — |
| | | | RB2 | — | 100 | — | 100 | — |
| | | | RB3 | — | — | 100 | — | 100 |
| | | | RB4 | — | — | — | — | — |
| | | Crosslinking agent | | 10 | — | — | — | — |
| | | Reactive diluent | | — | 30 | 20 | 30 | 20 |
| | | Polymerization initiator (long wavelength) | | — | 5 | — | 5 | — |
| | | Polymerization initiator (short wavelength) | | — | 2.5 | — | 2.5 | — |
| | | Carbon-based electrically conducting agent | C2 | — | — | — | — | — |
| | | | C3 | 2 | — | 2 | — | 2 |
| | | ionic electrically conducting agent | | — | 5 | — | 5 | — |
| | | Solvent | S2 | (*) | (*) | (*) | — | — |
| | | Layer thickness (μm) | | 50 | 60 | 80 | 20 | 30 |
| | Formation method | Film formation | | dipping | dipping | dipping | coater | coater |
| | | Film curing | | heating | ultraviolet ray | electron beam | ultraviolet ray | electron beam |
| Elastic layer | Presence or absence-Kind | | | none | none | none | none | none |
| Roller properties | Resistance (Ω) | | | $7 \times 10^4$ | $8 \times 10^6$ | $5 \times 10^4$ | $5 \times 10^5$ | $3 \times 10^4$ |
| | Initial surface roughness Rz (μm) | | | 2.2 | 2.1 | 1.8 | 2.8 | 2.9 |
| | Universal hardness ($N/mm^2$) | | | 0.6 | 1.2 | 1.5 | 2.3 | 1.9 |
| | Initial | Toner charging amount (μC/g) | | 31 | 33 | 31 | 24 | 25 |
| | | Toner transporting amount ($mg/cm^2$) | | 0.27 | 0.24 | 0.22 | 0.26 | 0.26 |
| | After 10000 papers | Toner charging amount (μC/g) | | 25 | 29 | 27 | 17 | 19 |
| | | Toner transporting amount ($mg/cm^2$) | | 0.29 | 0.27 | 0.23 | 0.28 | 0.28 |
| Evaluations of image | Initial | image concentration | | 4 | 4 | 4 | 4 | 4 |
| | | fogging | | 4 | 4 | 4 | 4 | 4 |
| | | concentration difference between leading and trailing ends | | 4 | 4 | 4 | 4 | 4 |
| | | image unevenness | | 4 | 4 | 4 | 4 | 4 |
| | | change of environment | | 4 | 4 | 4 | 4 | 4 |
| | After 10000 papers | image concentration | | 4 | 4 | 4 | 4 | 4 |
| | | fogging | | 4 | 4 | 4 | 4 | 4 |
| | | concentration difference between leading and trailing ends | | 4 | 4 | 4 | 4 | 4 |
| | | image unevenness | | 4 | 4 | 4 | 4 | 4 |
| | | Presence or absence of blade trace | | 5 | 4 | 4 | 4 | 4 |
| | | Toner filming to roller | | 4 | 4 | 4 | 4 | 4 |

(*) ratio of solvent compounded: adjusted to 15% solution

TABLE 23

| | | | | Example 6f | Example 7f | Example 8f | Example 9f | Comparative Example 1f |
|---|---|---|---|---|---|---|---|---|
| First resin layer | Compounding recipe (part by weight) | Base resin | RA | 100 | none | none | none | none |
| | | Carbon-based electrically conducting agent | C1 | 20 | | | | |
| | | Solvent | S1 | (*) | | | | |
| | | Layer thickness (μm) | | 50 | | | | |
| | Formation method | Film formation | | | | | | |
| | | Film curing | | | | | | |
| Second resin layer | Compounding recipe (part by weight) | Base resin | RB1 | — | — | — | — | none |
| | | | RB2 | 100 | — | — | 100 | |
| | | | RB3 | — | — | — | — | |
| | | | RB4 | — | 100 | 100 | — | |
| | | Crosslinking agent | | — | — | — | — | |
| | | Reactive diluent | | 30 | 20 | 20 | 30 | |
| | | Polymerization initiator (long wavelength) | | 5 | 5 | 5 | — | |
| | | Polymerization initiator (short wavelength) | | 2.5 | 2.5 | 2.5 | — | |
| | | Carbon-based electrically conducting agent | C2 | — | — | — | — | |
| | | | C3 | — | — | — | 2 | |
| | | ionic electrically conducting agent | | — | — | — | — | |
| | | Solvent | S2 | (*) | — | — | (*) | |
| | | Layer thickness (μm) | | 10 | 10 | 10 | 500 | |
| | Formation method | Film formation | | dipping | coater | coater | dipping | |
| | | Film curing | | ultraviolet ray | ultraviolet ray | ultraviolet ray | electron beam | |
| Elastic layer | Presence or absence-Kind | | | none | urethane | silicon | none | none |
| Roller properties | Resistance (Ω) | | | $3 \times 10^7$ | $6 \times 10^6$ | $7 \times 10^6$ | $3 \times 10^7$ | metal conduction |
| | Initial surface roughness Rz (μm) | | | 1.6 | 4.2 | 3.6 | 0.6 | 6 |
| | Universal hardness ($N/mm^2$) | | | 1 | 0.7 | 0.4 | 2.9 | — |
| | Initial | Toner charging amount (μC/g) | | 37 | 35 | 37 | 30 | 19 |
| | | Toner transporting amount ($mg/cm^2$) | | 0.23 | 0.37 | 0.36 | 0.15 | 0.3 |
| | After 10000 papers | Toner charging amount (μC/g) | | 36 | 35 | 37 | 25 | 10 |
| | | Toner transporting amount ($mg/cm^2$) | | 0.24 | 0.37 | 0.36 | 0.18 | 0.33 |
| Evaluations of image | Initial | image concentration | | 4 | 4 | 4 | 3 | 4 |
| | | fogging | | 4 | 4 | 4 | 4 | 4 |
| | | concentration difference between leading and trailing ends | | | | | | |
| | | image unevenness | | 4 | 4 | 4 | 4 | 3 |
| | | change of environment | | 4 | 4 | 4 | 4 | 4 |
| | After 10000 papers | image concentration | | 4 | 4 | 4 | 3 | 2 |
| | | fogging | | 4 | 4 | 4 | 4 | 1 |
| | | concentration difference between leading and trailing ends | | 4 | 4 | 4 | 3 | 1 |
| | | image unevenness | | 4 | 4 | 4 | 4 | 1 |
| | | Presence or absence of blade trace | | 5 | 5 | 5 | 3 | 1 |
| | | Toner filming to roller | | 4 | 5 | 5 | 3 | 1 |

(*) ratio of solvent compounded: adjusted to 15% solution

TABLE 24

| Kind of material | | Name of material | Model Number (name of maker) | Remarks |
|---|---|---|---|---|
| Base resin | RA | nylon copolymer | CM8000 (Toray Industries, Inc.) | |
| | RB1 | polyester urethane | UR8300 (Toyobo Co., Ltd.) | |
| | RB2 | | UR8401 (Toyobo Co., Ltd.) | |
| | RB3 | urethane acrylate oligomer | UV3200 (Nippon Gosei Kagaku Co., Ltd.) | |
| | RB4 | | UA-NDP (Shin-Nakamura Kagaku Co., Ltd.) | |
| | RB5 | | UF8001 (Kyoei-Sha Kagaku Co., Ltd.) | |
| Crosslinking agent | | isocyanate | HX (Nippon Polyurethane Co. Ltd.) | |
| Reactive diluent | | methoxytriethylene glycol acrylate | MTG-A (Kyoei-Sha Kagaku Co., Ltd.) | |
| Polymerization initiator (long wavelength) | | acylphosphine oxide | IRGACURE819 (Chiba Specialty Chemicals Co., Ltd.) | maximum wavelength: 430 nm |
| Polymerization initiator (short wavelength) | | α-hydroxyketone | IRGACURE184 (Chiba Specialty Chemicals Co., Ltd.) | maximum wavelength: 300 nm |
| Carbon-based electrically conducting agent | C1 | carbon black | Printex35 (Degussa) | |
| | C2 | | Denka Black (Denki Kagaku Kogyo Co., Ltd.) | |
| | C3 | | Ketjenblack EC | |
| Ionic electrically conducting agent | | sodium perchlorate | | |
| Solvent | S1 | ethanol | | |
| | S2 | MEK | | |

TABLE 25

| | | | | Example 1g | Example 2g | Example 3g | Example 4g | Example 5g | Example 6g |
|---|---|---|---|---|---|---|---|---|---|
| First resin layer | Compounding recipe (part by weight) | Base resin | RA | none | none | none | none | none | none |
| | | Carbon-based electrically conducting agent | C1 | | | | | | |
| | | Solvent | S1 | | | | | | |
| | | Layer thickness (μm) | | | | | | | |
| | Formation method | Film formation | | | | | | | |
| | | Film curing | | | | | | | |
| Second resin layer | Compounding recipe (part by weight) | Base resin | RB1 | 100 | — | — | — | — | — |
| | | | RB2 | — | 100 | — | — | — | — |
| | | | RB3 | — | — | — | — | 100 | — |
| | | | RB4 | — | — | — | 100 | — | 100 |
| | | | RB5 | — | — | 100 | — | — | — |
| | | Crosslinking agent | | 10 | 10 | — | — | — | — |
| | | Reactive diluent | | — | — | 20 | 20 | 20 | 20 |
| | | Polymerization initiator (long wavelength) | | — | — | — | — | 2 | — |
| | | Polymerization initiator (short wavelength) | | — | — | 2.5 | — | 2.5 | — |
| | | Carbon-based electrically conducting agent | C2 | — | — | — | — | — | — |
| | | | C3 | 2 | — | 2 | 2 | — | 2 |
| | | ionic electrically conducting agent | | — | — | 5 | — | 5 | — |
| | | Solvent | S2 | (*) | (*) | (*) | (*) | — | — |
| | | Layer thickness (μm) | | 40 | 20 | 40 | 50 | 15 | 20 |
| | Formation method | Film formation | | dipping | dipping | dipping | dipping | coater | coater |
| | | Film curing | | heating | heating | ultraviolet ray | electron beam | ultraviolet ray | electron beam |
| Elastic layer | Presence or absence-Kind | | | none | none | none | none | none | none |
| Roller properties | Resistance (Ω) | | | $7 \times 10^4$ | $3 \times 10^7$ | $4 \times 10^5$ | $1 \times 10^4$ | $8 \times 10^5$ | $7 \times 10^3$ |
| | Initial surface roughness Rz (μm) | | | 2.5 | 2.8 | 2.4 | 2.0 | 3 | 3.5 |
| | Universal hardness | | | >10 | 0.5 | >10 | >10 | 0.3 | >10 |
| | Initial | Toner charging amount (μC/g) | | 28 | 34 | 27 | 26 | 28 | 25 |
| | | Toner transporting amount (mg/cm$^2$) | | 0.27 | 0.28 | 0.25 | 0.24 | 0.29 | 0.33 |
| | After 10000 papers | Toner charging amount (μC/g) | | 21 | 32 | 23 | 20 | 25 | 20 |
| | | Toner transporting amount (mg/cm$^2$) | | 0.30 | 0.29 | 0.28 | 0.27 | 0.30 | 0.35 |
| Evaulations of image | Initial | image concentration | | 4 | 4 | 4 | 4 | 4 | 4 |
| | | fogging | | 4 | 4 | 4 | 4 | 4 | 4 |
| | | concentration difference between leading and trailing ends | | 4 | 4 | 4 | 4 | 4 | 4 |
| | | image unevenness | | 4 | 4 | 4 | 4 | 4 | 4 |
| | | ghost | | 4 | 4 | 4 | 4 | 4 | 4 |
| | | gradation | | 3 | 4 | 3 | 3 | 4 | 3 |
| | | change of environment | | 4 | 4 | 4 | 4 | 4 | 4 |
| | After 10000 papers | image concentration | | 4 | 4 | 4 | 4 | 4 | 4 |
| | | fogging | | 4 | 4 | 4 | 4 | 4 | 4 |
| | | concentration difference between leading and trailing ends | | 4 | 4 | 4 | 4 | 4 | 4 |
| | | image unevenness | | 4 | 4 | 4 | 4 | 4 | 4 |
| | | Presence or absence of blade trace | | 4 | 3 | 3 | 3 | 4 | 4 |
| | | Toner filming to roller | | 3 | 3 | 4 | 4 | 4 | 4 |

(*) ratio of solvent compounded: adjusted to 15% solution

TABLE 26

| | | | | Example 7g | Example 8g | Example 9g | Example 10g | Comparative Example 1g |
|---|---|---|---|---|---|---|---|---|
| First resin layer | Compounding recipe (part by weight) | Base resin | RA | 100 | none | none | none | none |
| | | Carbon-based electrically conducting agent | C1 | 20 | | | | |
| | | Solvent | S1 | (*) | | | | |
| | | Layer thickness (μm) | | 50 | | | | |
| | Formation method | Film formation | | | | | | |
| | | Film curing | | | | | | |
| Second resin layer | Compounding recipe (part by weight) | Base resin | RB1 | — | — | — | — | none |
| | | | RB2 | — | — | — | — | |
| | | | RB3 | 100 | 100 | 100 | — | |
| | | | RB4 | — | — | — | — | |
| | | | RB5 | — | — | — | 100 | |
| | | Crosslinking agent | | — | — | — | — | |
| | | Reactive diluent | | 20 | 20 | 20 | 20 | |
| | | Polymerization initiator (long wavelength) | | 5 | 5 | 5 | — | |
| | | Polymerization initiator (short wavelength) | | 2.5 | 2.5 | 2.5 | — | |

TABLE 26-continued

| | | | | Example 7g | Example 8g | Example 9g | Example 10g | Comparative Example 1g |
|---|---|---|---|---|---|---|---|---|
| | | Carbon-based | C2 | — | — | — | — | |
| | | electrically conducting agent | C3 | — | — | — | 2 | |
| | | ionic electrically conducting agent | | — | — | — | — | |
| | | Solvent | S2 | (*) | — | — | (*) | |
| | | Layer thickness (μm) | | 10 | 10 | 10 | 500 | |
| | Formation method | Film formation | | dipping | coater | coater | dipping | |
| | | Film curing | | ultraviolet ray | ultraviolet ray | ultraviolet ray | electron beam | |
| Elastic layer | | Presence or absence-Kind | | none | urethane | silicon | none | none |
| Roller properties | | Resistance (Ω) | | $3 \times 10^7$ | $3 \times 10^6$ | $5 \times 10^6$ | $5 \times 10^5$ | metal conduction |
| | | Initial surface roughness Rz (μm) | | 1.7 | 3.9 | 3.8 | 0.9 | 6 |
| | | Universal hardness | | 0.3 | 0.4 | 0.4 | >10 | — |
| | Initial | Toner charging amount (μC/g) | | 37 | 35 | 35 | 29 | 19 |
| | | Toner transporting amount (mg/cm$^2$) | | 0.23 | 0.34 | 0.34 | 0.19 | 0.3 |
| | After 10000 papers | Toner charging amount (μC/g) | | 36 | 35 | 35 | 19 | 10 |
| | | Toner transporting amount (mg/cm$^2$) | | 0.24 | 0.34 | 0.34 | 0.20 | 0.33 |
| Evaulations of image | Initial | image concentration | | 4 | 4 | 4 | 3 | 4 |
| | | fogging | | 4 | 4 | 4 | 4 | 4 |
| | | concentration difference between leading and trailing ends | | 4 | 4 | 4 | 4 | 2 |
| | | image unevenness | | 4 | 4 | 4 | 4 | 2 |
| | | ghost | | 3 | 3 | 3 | 3 | 4 |
| | | gradation | | 5 | 5 | 5 | 3 | 2 |
| | | change of environment | | 4 | 4 | 4 | 4 | 4 |
| | After 10000 papers | image concentration | | 4 | 4 | 4 | 3 | 1 |
| | | fogging | | 4 | 4 | 4 | 4 | 1 |
| | | concentration difference between leading and trailing ends | | 4 | 4 | 4 | 3 | 1 |
| | | image unevenness | | 4 | 4 | 4 | 4 | 1 |
| | | Presence or absence of blade trace | | 3 | 3 | 3 | 3 | 1 |
| | | Toner filming to roller | | 4 | 5 | 5 | 3 | 1 |

(*) ratio of solvent compounded: adjusted to 15% solution

TABLE 27

| Kind of material | | Name of material | Model Number (name of maker) | Remarks |
|---|---|---|---|---|
| Base resin | RA | nylon copolymer | CM8000 (Toray Industries, Inc.) | |
| | RB1 | polyester urethane | UR8300 (Toyobo Co., Ltd.) | |
| | RB2 | | UR8401 (Toyobo Co., Ltd.) | |
| | RB3 | urethane acrylate oligomer | UV3200 (Nippon Gosei Kagaku Co., Ltd.) | |
| | RB4 | | UA-NDP (Shin-Nakamura Kagaku Co., Ltd.) | |
| | RB5 | | UF8001 (Kyoei-Sha Kagaku Co., Ltd.) | |
| Crosslinking agent | | isocyanate | HX (Nippon Polyurethane Co. Ltd.) | |
| Reactive diluent | | methoxytriethylene glycol acrylate | MTG-A (Kyoei-Sha Kagaku Co., Ltd.) | |
| Polymerization initiator (long wavelength) | | acylphosphine oxide | IRGACURE819 (Chiba Specialty Chemicals Co., Ltd.) | maximum wavelength: 430 nm |
| Polymerization initiator (short wavelength) | | α-hydroxyketone | IRGACURE184 (Chiba Specialty Chemicals Co., Ltd.) | maximum wavelength: 300 nm |
| Carbon-based electrically conducting agent | C1 | carbon black | Printex35 (Degussa) | |
| | C2 | | Denka Black (Denki Kagaku Kogyo Co., Ltd.) | |
| | C3 | | Ketjenblack EC | |
| Ionic electrically conducting agent | | sodium perchlorate | | |
| Solvent | S1 | ethanol | | |
| | S2 | MEK | | |

TABLE 28

| | | | | Example 1h | Example 2h | Example 3h | Example 4h | Example 5h | Example 6h |
|---|---|---|---|---|---|---|---|---|---|
| First resin layer | Compounding recipe (part by weight) | Base resin | RA | none | none | none | none | none | none |
| | | Carbon-based electrically conducting agent | C1 | | | | | | |
| | | Solvent | S1 | | | | | | |
| | | Layer thickness (μm) | | | | | | | |
| | Formation method | Film formation | | | | | | | |
| | | Film curing | | | | | | | |
| Second resin layer | Compounding recipe (part by weight) | Base resin | RB1 | 100 | — | — | — | — | — |
| | | | RB2 | — | 100 | — | — | — | — |
| | | | RB3 | — | — | 100 | — | 100 | — |

TABLE 28-continued

| | | | | Example 1h | Example 2h | Example 3h | Example 4h | Example 5h | Example 6h |
|---|---|---|---|---|---|---|---|---|---|
| | | | RB4 | — | — | — | 100 | — | 100 |
| | | | RB5 | — | — | — | — | — | — |
| | | Crosslinking agent | | 10 | 10 | — | — | — | — |
| | | Reactive diluent | | — | — | 40 | 40 | 40 | 40 |
| | | Polymerization initiator (long wavelength) | | — | — | 5 | — | 5 | — |
| | | Polymerization initiator (short wavelength) | | — | — | 2.5 | — | 2.5 | — |
| | | Carbon-based | C2 | — | — | — | — | — | |
| | | electrically conducting agent | C3 | 2 | — | 2 | 2 | — | 2 |
| | | ionic electrically conducting agent | | — | — | — | — | 2 | — |
| | | Solvent | S2 | (*) | (*) | (*) | (*) | — | — |
| | | Layer thickness (μm) | | 30 | 20 | 40 | 50 | 15 | 20 |
| | Formation method | Film formation | | dipping | dipping | dipping | dipping | coater | coater |
| | | Film curing | | heating | heating | ultraviolet ray | electron beam | ultraviolet ray | electron beam |
| Elastic layer | | Presence or absence-Kind | | none | none | none | none | none | none |
| Roller properties | | Resistance (Ω) | | $4 \times 10^4$ | $4 \times 10^7$ | $1 \times 10^4$ | $5 \times 10^5$ | $7 \times 10^5$ | $8 \times 10^3$ |
| | | Initial surface roughness Rz (μm) | | 2.7 | 2.9 | 2.2 | 2.0 | 3.2 | 3.5 |
| | | Maximum surface potential (V) | | 12 | 30 | 13 | 15 | 40 | 5 |
| | Initial | Toner charging amount (μC/g) | | 29 | 35 | 27 | 29 | 28 | 27 |
| | | Toner transporting amount (mg/cm$^2$) | | 0.28 | 0.29 | 0.26 | 0.23 | 0.3 | 0.33 |
| | After 10000 papers | Toner charging amount (μC/g) | | 22 | 32 | 24 | 23 | 25 | 22 |
| | | Toner transporting amount (mg/cm$^2$) | | 0.30 | 0.30 | 0.28 | 0.25 | 0.31 | 0.35 |
| Evaulations of image | Initial | image concentration | | 4 | 4 | 4 | 4 | 4 | 4 |
| | | fogging | | 4 | 4 | 4 | 4 | 4 | 4 |
| | | concentration difference between leading and trailing ends | | 4 | 4 | 4 | 4 | 4 | 4 |
| | | image unevenness | | 4 | 4 | 4 | 4 | 4 | 4 |
| | | ghost | | 4 | 4 | 4 | 4 | 4 | 4 |
| | | gradation | | 3 | 4 | 3 | 3 | 4 | 3 |
| | | change of environment | | 4 | 4 | 4 | 4 | 4 | 4 |
| | After 10000 papers | image concentration | | 4 | 4 | 4 | 4 | 4 | 4 |
| | | fogging | | 4 | 4 | 4 | 4 | 4 | 4 |
| | | concentration difference between leading and trailing ends | | 4 | 4 | 4 | 4 | 4 | 4 |
| | | image unevenness | | 4 | 4 | 4 | 4 | 4 | 4 |
| | | Presence or absence of blade trace | | 4 | 3 | 3 | 3 | 4 | 4 |
| | | Toner filming to roller | | 3 | 3 | 4 | 4 | 4 | 4 |

(*) ratio of solvent compounded: adjusted to 15% solution

TABLE 29

| | | | | Example 7h | Example 8h | Example 9h | Example 10h | Comparative Example 1h |
|---|---|---|---|---|---|---|---|---|
| First resin layer | Compounding recipe (part by weight) | Base resin | RA | 100 | none | none | none | none |
| | | Carbon-based electrically | C1 | 20 | | | | |
| | | Solvent | S1 | (*) | | | | |
| | | Layer thickness (μm) | | 50 | | | | |
| | Formation method | Film formation | | | | | | |
| | | Film curing | | | | | | |
| Second resin layer | Compounding recipe (part by weight) | Base resin | RB1 | — | — | — | — | none |
| | | | RB2 | — | — | — | — | |
| | | | RB3 | 100 | 100 | 100 | — | |
| | | | RB4 | — | — | — | — | |
| | | | RB5 | — | — | — | 100 | |
| | | Crosslinking agent | | — | — | — | — | |
| | | Reactive diluent | | 40 | 40 | 40 | 40 | |
| | | Polymerization initiator (long wavelength) | | 5 | 5 | 5 | — | |
| | | Polymerization initiator (short wavelength) | | 2.5 | 2.5 | 2.5 | — | |
| | | Carbon-based | C2 | — | — | — | — | |
| | | electrically | C3 | — | — | — | 2 | |
| | | ionic electrically conducting agent | | — | — | — | — | |
| | | Solvent | S2 | 10 | — | — | (*) | |
| | | Layer thickness (μm) | | 10 | 10 | 10 | 500 | |
| | Formation method | Film formation | | dipping | coater | coater | dipping | |
| | | Film curing | | ultraviolet ray | ultraviolet ray | ultraviolet ray | electron beam | |
| Elastic layer | | Presence or absence-Kind | | none | urethane | silicon | none | none |
| Roller properties | | Resistance (Ω) | | $4 \times 10^7$ | $4 \times 10^6$ | $5 \times 10^6$ | $3 \times 10^5$ | metal conduction |

TABLE 29-continued

| | | | Example 7h | Example 8h | Example 9h | Example 10h | Comparative Example 1h |
|---|---|---|---|---|---|---|---|
| | Initial surface roughness Rz (μm) | | 1.8 | 4 | 3.8 | 0.8 | 6 |
| | Maximum surface potential (V) | | 80 | 60 | 70 | 20 | — |
| | Inital | Toner charging amount (μC/g) | 38 | 34 | 35 | 28 | 19 |
| | | Toner transporting amount (mg/cm$^2$) | 0.22 | 0.35 | 0.34 | 0.18 | 0.3 |
| | After 10000 papers | Toner charging amount (μC/g) | 38 | 34 | 35 | 20 | 10 |
| | | Toner transporting amount (mg/cm$^2$) | 0.23 | 0.35 | 0.34 | 0.19 | 0.33 |
| Evaulations of image | Initial | image concentration | 4 | 4 | 4 | 3 | 4 |
| | | fogging | 4 | 4 | 4 | 4 | 4 |
| | | concentration difference between leading and trailing ends | 4 | 4 | 4 | 4 | 3 |
| | | image unevenness | 4 | 4 | 4 | 4 | 2 |
| | | ghost | 3 | 3 | 3 | 3 | 4 |
| | | gradation | 5 | 5 | 5 | 3 | 2 |
| | | change of environment | 4 | 4 | 4 | 4 | 4 |
| | After 10000 papers | image concentration | 4 | 4 | 4 | 4 | 1 |
| | | fogging | 4 | 4 | 4 | 4 | 1 |
| | | concentration difference between leading and trailing ends | 4 | 4 | 4 | 4 | 1 |
| | | image unevenness | 4 | 4 | 4 | 4 | 1 |
| | | Presence or absence of blade trace | 3 | 3 | 3 | 3 | 1 |
| | | Toner filming to roller | 4 | 5 | 5 | 3 | 1 |

(*) ratio of solvent compounded: adjusted to 15% solution

INDUSTRIAL APPLICABILITY

The developing roller according to the invention is preferably used by mounting onto an imaging apparatus such as a plain paper copier, a plain paper facsimile machine, a laser beam printer, a color laser beam printer, a toner jet printer or the like as a charging roller, a developing roller, a transfer roller, a paper feed roller, a toner feed roller or the like.

The invention claimed is:

1. A developing roller comprising a shaft member to be born at its both longitudinal end portions and at least one resin layer formed on a radially outer surface thereof for feeding a non-magnetic developing agent carried on an outer peripheral surface to a latent image support, wherein the shaft member is made of a metal pipe, and at least one of the resin layers is constituted with a resin dispersing fine particles therein, wherein a ratio a/b of average particle size of fine particles a to total thickness of resin layers b is greater than 2.0 and less than or equal to 5.0.

2. A developing roller according to claim 1, wherein the resin layer is constituted with two or more layers, and a layer located at an outermost side in a radial direction is a second resin layer and a layer adjoining at an inside of the second resin layer is a first resin layer, and the fine particles are not included in the second resin layer but are dispersed in only the first resin layer.

3. A developing roller according to claim 2, wherein the first resin layer has a volume resistivity of not more than $10^6$ Ω·cm and the second resin layer has a volume resistivity of not less than $10^{10}$ Ω·cm.

4. A developing roller according to claim 1, wherein the fine particles have an average particle size of 1-50 μm.

5. A developing roller according to claim 1, wherein a content of the fine particles is 0.1-100 parts by weight per 100 parts by weight of the resin.

6. A developing roller according to claim 1, wherein the resin layers have a total thickness of 1-50 μm.

7. A developing roller according to claim 1, wherein the fine particles are made from rubber or a synthetic resin.

8. A developing roller according to claim 7, wherein the fine particles are at least one selected from silicone rubber fine particles, acryl fine particles, styrene fine particles, acryl-styrene copolymer fine particles, fluorine resin fine particles, urethane elastomer fine particles, urethane acrylate fine particles, melamine resin fine particles and phenolic resin fine particles.

9. A developing roller according to claim 1, wherein at least one layer of the resin layers is made from a ultraviolet-curing type resin or an electron beam curing type resin.

10. A developing roller according to claim 1, wherein the resin layer at least located at the outermost side in the radial direction is made from a resin containing at least one of fluorine and silicon.

11. A developing roller according to claim 1, wherein the resin layers have a total thickness of 1-500 μm.

12. A developing roller according to claim 1, wherein at least one of the resin layers is constituted with an ultraviolet-curing type resin containing an electrically conducting agent comprising at least a carbon-based material, and wherein a content of the carbon-based electrically conducting agent included in the ultraviolet-curing type resin is 1-20 parts by weight per 100 parts by weight of the resin.

13. A developing roller according to claim 1, wherein at least one of the resin layers is constituted with an ultraviolet-curing type resin containing an electrically conducting agent comprising at least a carbon-based material, and wherein the electrically conducting agent included in the ultraviolet-curing type resin or the electron beam curing type resin is constituted with two or more kinds.

14. A developing roller according to claim 1, wherein an elastic layer is arranged between the shaft member and an innermost resin layer.

15. A developing roller according to claim 1, wherein the shaft member is made from a metal selected from aluminum, stainless steel, iron and an alloy containing any one thereof.

16. An imaging apparatus comprised a developing roller as claimed in claim 1.

* * * * *